US008144103B2

(12) United States Patent
Murakami et al.

(10) Patent No.: US 8,144,103 B2
(45) Date of Patent: Mar. 27, 2012

(54) DRIVING CIRCUIT OF DISPLAY DEVICE, METHOD OF DRIVING DISPLAY DEVICE, AND DISPLAY DEVICE FOR ENABLING PARTIAL SCREEN AND WIDESCREEN DISPLAY MODES

(75) Inventors: Yuhichiroh Murakami, Mie (JP); Seijirou Gyouten, Mie (JP); Noboru Matsuda, Kyoto (JP); Hajime Washio, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 1140 days.

(21) Appl. No.: 11/921,444

(22) PCT Filed: Jun. 12, 2006

(86) PCT No.: PCT/JP2006/311758

§ 371 (c)(1),
(2), (4) Date: Dec. 3, 2007

(87) PCT Pub. No.: WO2006/134873

PCT Pub. Date: Dec. 21, 2006

(65) Prior Publication Data

US 2009/0027318 A1 Jan. 29, 2009

(30) Foreign Application Priority Data

Jun. 14, 2005 (JP) ..... 2005-174387

(51) Int. Cl.
*G09G 3/36* (2006.01)

(52) U.S. Cl. ..... 345/100; 345/98; 345/99; 345/204; 377/64

(58) Field of Classification Search ..... 345/98–100; 377/64–81
See application file for complete search history.

(56) References Cited

U.S. PATENT DOCUMENTS

| | | | | |
|---|---|---|---|---|
| 5,625,376 | A | 4/1997 | Maekawa | |
| 5,748,175 | A | 5/1998 | Shimada et al. | |
| 6,232,945 | B1 * | 5/2001 | Moriyama et al. | 345/98 |
| 6,429,836 | B1 * | 8/2002 | Hansen | 345/74.1 |
| 6,469,686 | B1 | 10/2002 | Koyama et al. | |
| 6,492,972 | B1 | 12/2002 | Kubota et al. | |
| 2001/0005196 | A1 * | 6/2001 | Ishii | 345/100 |
| 2001/0033261 | A1 * | 10/2001 | Washio et al. | 345/87 |
| 2003/0179174 | A1 | 9/2003 | Matsuda et al. | |
| 2003/0206149 | A1 * | 11/2003 | Yamashita et al. | 345/92 |
| 2004/0257350 | A1 * | 12/2004 | Kobayashi | 345/204 |
| 2005/0110734 | A1 * | 5/2005 | Hirosawa | 345/87 |

(Continued)

FOREIGN PATENT DOCUMENTS

JP 07-20816 1/1995

(Continued)

*Primary Examiner* — Lun-Yi Lao
*Assistant Examiner* — Gene W Lee
(74) *Attorney, Agent, or Firm* — Harness, Dickey & Pierce, P.L.C.

(57) ABSTRACT

A driving circuit of a display device is disclosed in accordance with an embodiment of the present invention creates a non-display area on a display section of the display device so that a partial-screen display becomes available. The driving circuit includes a shift register and a signal processing circuit that processes a signal tapped off from the shift register. In partial-screen display, the signal processing circuit interrupts a signal tapped off from a predetermined stage of the shift register. This makes it possible to realize a driving circuit of a display device by which a high-quality display is possible with a small circuit area.

21 Claims, 35 Drawing Sheets

U.S. PATENT DOCUMENTS

2006/0061540 A1* 3/2006 Harada ..... 345/103

FOREIGN PATENT DOCUMENTS

| | | |
|---|---|---|
| JP | 8-79663 | 3/1996 |
| JP | 10-333650 | 5/1997 |
| JP | 10-97230 | 4/1998 |
| JP | 11-272226 | 10/1999 |
| JP | 2004-5904 | 1/2004 |

* cited by examiner

SSPB
WL
NL
INI
LR
CK
CKB
ASPE
PVID
VID
VDD
VSS
IN3
IN4
SRd6
SRd5
SRd4
SR307
SR272
SR271
SR270
SR269
QBI
QBr
Rrr
Rll
QB
P
Ls
Q
DLd4
DL307
DL272
DL271
DL270
DL269
DLS d4
DLP d4
DLS 307
DLP 307
DLS 272
DLP 272
DLS 271
DLP 271
DLS 270
DLP 270
DLS 269
DLP 269
OUT
BuS d4
BuP d4
BuS 307
BuP 307
BuS 272
BuP 272
BuS 271
BuP 271
BuS 270
BuP 270
BuS 269
BuP 269
Bud4
Bu307
Bu272
Bu271
Bu 270
Bu269
SMd4
SM307
SM272
SM271
SM270
SM269
1
2
3
4
5b
6
7b
8

| INPUT | | OUTPUT | | | |
|---|---|---|---|---|---|
| ASPEC | LR | WL | WR | NL | NR |
| H | H | H | L | L | L |
| H | L | L | H | L | L |
| L | H | L | L | H | L |
| L | L | L | L | L | H |

DRIVING CIRCUIT OF DISPLAY DEVICE, METHOD OF DRIVING DISPLAY DEVICE, AND DISPLAY DEVICE FOR ENABLING PARTIAL SCREEN AND WIDESCREEN DISPLAY MODES

TECHNICAL FIELD

The present invention relates to a circuit that drives a display device such as a liquid crystal display device.

BACKGROUND ART

FIG. 39 is a circuit diagram showing a configuration of a conventional active matrix display device. As shown in this figure, the active matrix display device includes pixels (PXL) arranged in matrix on a horizontally oriented screen. Rows of the pixels are respectively connected to gate lines 201. The gate lines are connected to a vertical driver (vertical driving circuit) 202. On the other hand, columns of the pixels are respectively connected to data lines 203. Further, a signal line 204 is provided to feed a video signal (image signal) Vsig to the pixels. The signal line 204 is connected to the respective data lines 203 via sampling switches SW. The sampling switches operate to open and close sequentially in accordance with a control by a horizontal shift register (SR) via a horizontal driver 205.

The columns of the pixels of the horizontally oriented screen are divided into a predetermined section and extended sections. The predetermined section is assigned to a normal display. The extended sections each become a part of a wide display. The predetermined section contains pixels of the $L+1^{th}$ column to the $M^{th}$ column. The extended sections contain pixels of the $1^{st}$ column to the $L^{th}$ column, and pixels of the $M+1^{th}$ to the $N^{th}$ column. The horizontal shift register (SR) is divided into a predetermined-stage section (SRB) and extended-stage sections (SRA, SRC). The predetermined-stage section corresponds to the columns of the pixels in the predetermined section. The extended-stage sections (SRA, SRC) correspond to the columns of the pixels in the extended sections. In wide display, the predetermined-stage section (SRB) and the extended-stage sections (SRA, SRC) of the horizontal shift register are coupled serially to combine, and open and close all of the sampling switches sequentially. In normal display, the extended-stage sections (SRA, SRC) of the horizontal shift register are decoupled from the predetermined-stage section (SRB) so that only the sampling switches belonging to the predetermined section are opened and closed sequentially.

With this conventional arrangement, the horizontal shift register is divided into three sections: the extended front-stage section SRA; the predetermined in-between-stage section SRB; and the extended rear-stage section SRC. A first gate circuit G0 is connected to an input terminal of the extended front-stage section SRA. A second gate circuit G1 is provided across an output terminal of the extended front-stage section SRA and an input terminal of the predetermined in-between-stage section SRB. A third gate circuit G2 is provided across an output terminal of the predetermined in-between-stage section SRB and an input terminal of the extended rear-stage section SRC. The gate circuits G0, G1, G2 are controlled to switch in accordance with control signals CTL0, CTL1, CTL2 to selectively combine and decouple the horizontal shift register. The first gate circuit G0, which is provided at a front end, is fed with a start signal ST for the shift register.

In the foregoing arrangement, the control signals CTL0, CTL1, CTL2 are all set to Low-level in wide display by an external control circuit. In some cases, the signals CTL0, CTL1, CTL2 may be fed via a shared control line. If CTL0 is set to Low-level in wide display, the start signal ST having been fed into the first gate circuit G0 is fed into the extended front-stage section SRA of the horizontal shift register. SRA transfers the start signal ST sequentially in synchronization with a predetermined clock signal to sequentially open, via the horizontal driver 205, the sampling switches SW that correspond to the pixels of the $1^{st}$ column to the $L^{th}$ column. Consequently, the video signal Vsig fed from the signal line 204 is sampled by the data lines 203 that correspond to the pixels of the $1^{st}$ column to the $L^{th}$ column. Next, an output signal from the extended front-stage section SRA is fed into an input terminal of the predetermined in-between-stage section SRB. SRB, in the same manner; transfers the signal to sequentially control the driving of the corresponding pixels of the $L+1^{th}$ column to the $M^{th}$ column. The output signal of SRB is fed into the extended rear-stage section SRC. SRC, in the same manner, transfers the signal to sequentially control the driving of the corresponding pixels of the $M+1^{th}$ column to the $N^{th}$ column. As a result of the foregoing operation, the pixels of the $1^{st}$ column to the $N^{th}$ column are all driven sequentially to show a wide display.

On the other hand, the start signal ST having been fed into the first gate circuit G0 is fed into the second gate circuit G1 in normal display. Thus, the extended front-stage section SRA of the horizontal shift register is decoupled. Therefore, the start signal ST is fed into the input terminal of the predetermined in-between-stage section SRB. SRB transfers the start signal ST sequentially to drive the pixels of the $L+1^{th}$ column to the $M^{th}$ column via the horizontal driver 205 and the switching devices SW. The output signal of the SRB cannot pass through the third gate circuit G2. Thus, the extended rear-stage section SRC is decoupled. Accordingly, the SRB transfers the signals only in normal display.

With this conventional arrangement, the horizontal shift register constituted by flip-flops connected to form multi-stages is divided into the predetermined-stage section and the extended-stage sections. The predetermined-stage section corresponds to the normal display. The extended-stage sections correspond to the extended section in wide display. The predetermined-stage section and the extended-stage sections are connected via the gate circuits. In wide display, the predetermined-stage section and the extended-stage sections are connected serially via the gate circuits to combine. In normal display, the extended-stage sections are decoupled from the predetermined-stage section. Accordingly, it is possible to switch the wide display and the normal display with a simple arrangement in which the gate circuits are added to the horizontal shift register that is divided.

[Publication 1] Japanese Unexamined Patent Publication No. 20816/1995 (Tokukaihei 7-20816) (Publication Date: Jan. 24, 1995)

DISCLOSURE OF INVENTION

However, with the conventional arrangement, the shift register is divided into three sections, namely the extended front-stage section SRA, the predetermined in-between-stage section SRB, and the extended rear-stage section SRC. In normal display, SRA and SRC are decoupled so that only SRB operates. This makes it necessary to stop the shifting at end sections of SRB. Therefore, a special stage that is different from the other stages is provided at the ends of SRB (at in-between sections of the entire shift register). Inclusion of the stage of different configuration in a section (in-between section) other than the end sections of the shift register causes the loads to vary, which causes signal defects such as phase shift due to pulse delays or the like. This causes deterioration in display quality. Moreover, displaying at high speed becomes difficult. Further, the conventional arrangement requires the gate circuits G0, G1, G2, which produces a problem of increase in circuit area (frame area of the display device) by the gate circuits.

The present invention is in view of the foregoing problems, and has as an object to provide a driving circuit of a display device by which high-quality display is possible while restraining the circuit area.

To solve the above problems, a driving circuit of a display device of the present invention is adapted so that the driving circuit of the display device, by which a non-display area is created on a display section of the display device so that a partial-screen display becomes available, includes a shift register, and a signal processing circuit that processes a signal (pulse signal) tapped off from the shift register, and the signal processing circuit interrupts (e.g. an active signal is made non-active), in partial-screen display, a signal tapped off from a predetermined stage of the shift register (e.g. stage corresponding to the non-display area).

With this configuration, it is possible even in partial-screen display (e.g. the display area is created at a central area, and the non-display area is created at each side of the display section) to cause the shift register to shift from a shift starting stage up to a final stage (end stage of the shift register) to tap off a signal (generate a pulse), and to interrupt, at a lower stage of the shift register, a signal (pulse signal) of the stages corresponding to the non-display area. Thus, it is not necessary even in partial-screen display to stop the shift register between a first stage and a last stage of the shift register. Therefore, no special stage (stage of different configuration) needs to be provided in an in-between section of the shift register to stop the shifting. Accordingly, signal defects such as phase shifts resulting from inclusion of the stage of different configuration are restrained, so that high-quality display becomes possible. Further, the gate circuits that are necessary in the conventional configurations are unnecessary. This allows the circuit area to be restrained. Furthermore, it is possible to interrupt the signal (pulse signal) of the stages corresponding to the non-display area to stop the subsequent circuits. This allows reduction in power consumption.

In this configuration, it is possible to associate the partial-screen display (e.g. a display mode in which the display area is created at the central part, and the non-display area is created at each side of the display section) with a normal display mode, and to associate a full display with a wide display mode.

Further, it is preferable that each stage of the shift register include a set-reset flip-flop. A shift register employing a set-reset flip-flop must include a stage to stop the shifting. Therefore, when the shift register is applied to the conventional configurations, the shift register always includes the stage of different configuration in an in-between section of the shift register. On the contrary, in the present configuration, it is not necessary even in partial-screen display to stop the shift register between a first stage and a last stage of the shift register. Therefore, employment of a set-reset flip-flop does not result in inclusion of the stage of different configuration in an in-between section of the shift register. Thus, the present configuration is suitable for the case in which the shift register employs the set-reset flip-flop.

Further, it is preferable in the driving circuit of the display device that every stage of the shift register be same in configuration. This makes it possible to further restrain the signal defects such as phase shifts.

It is preferable that the shift register be enabled to shift in two directions. The shift register allowed to shift in two directions needs to have a stage, at each end section, to stop the shifting. Therefore, in the arrangement in which the shift register is to be stopped in between the first stage and the last stage of the shift register in partial-screen display, double stages of different configurations need to be provided in in-between sections of the shift register. On the other hand, in the present configuration, it is not necessary even in partial-screen display to stop the shift register between the first stage and the last stage of the shift register. Thus, although allowed to shift in two directions, the shift register does not include the stage of different configuration in an in-between section of the shift register. Therefore, the present configuration is suitable for the case in which the shift register that is enabled to shift in two directions is employed.

Further, the driving circuit of the display device may include an interrupting circuit that corresponds to the predetermined stage (stage that corresponds to the non-display area) of the shift register and is enabled to interrupt a signal tapped off from the stage. The signal to be tapped off from the stage may be a data sampling pulse or a precharge pulse.

Further, the interrupting circuit in the driving circuit of the display device may be arranged so as to use a partial-display mode signal, fed in partial-screen display, to interrupt a signal tapped off from a corresponding stage.

It is preferable in this arrangement that the interrupting circuit function as a delay circuit if the partial-display mode signal is not fed. Configuring the interrupting circuit in such a way as to, for example, function as a normal delay circuit if no partial-screen display signal is fed makes it possible to obtain the advantages above without increasing the size of the signal processing circuit. In this case, the interrupting circuit may be configured as follows. Specifically, the interrupting circuit includes a first NOR circuit and a logic circuit that includes a delay section. The logic circuit is fed with the partial-display mode signal and the signal tapped off from the corresponding stage. Two outputs of the logic circuit are both fed into the first NOR circuit. Note that at least one of the outputs of the logic circuit may be fixed in partial-screen display. Further, the logic circuit may be configured as follows. Specifically, the logic circuit includes a second NOR circuit and a delay section. The second NOR circuit is fed with the partial-display mode signal and an inversion signal of the signal tapped off from the corresponding stage. The delay section delays and inverts an output signal of the second NOR circuit. The logic circuit taps off the output signal of the delay section and the inversion signal of the signal tapped off from the corresponding stage. Note that an output signal of the delay section may be a fixed signal in partial-screen display.

Further, the driving circuit of the display device may be arranged such that a signal of a double pulse is tapped off from the shift register.

Further, the shift register in the driving circuit of the present display device may start shifting from an in-between stage of the shift register in partial-screen display. The in-between stage corresponds to the display section. For example, the shifting may be started at a stage corresponding to an end section of the non-display area of the display section in partial-screen display.

A method of driving a display device in accordance with the present invention is adapted so that, in the method of driving the display device, a pulse generated at each stage of a shift register is tapped off via a signal processing circuit to drive the display device, and to cause the display device to show a partial-screen display, the shift register is caused to operate from a shift starting stage up to a final stage and caused to tap off a pulse, and the signal processing circuit interrupts a pulse tapped off from a stage corresponding to a non-display area but does not interrupt a pulse tapped off from a stage corresponding to a display area.

It is possible in the method of driving the display device in accordance with the present invention that the pulse generated at the stage corresponding to the non-display area is interrupted by use of a partial-screen display signal.

It is possible in the method of driving the display device in accordance with the present invention that the shift register is caused to operate (shifting is started) from an in-between stage (this stage is determined on the basis of the position of the display area) to cause the display device to show a partial-screen display.

Further, it is possible in the method of driving the display device in accordance with the present invention that the pulse generated at the stage corresponding to the non-display area is interrupted by a NOR operation of the pulse and the partial-display signal that is a fixed signal.

Further, a method of driving a signal line in accordance with the present invention is adapted so that, in the method of driving a signal line, a pulse generated at each stage of a shift register is tapped off via a signal processing circuit to drive a plurality of signal lines, and to make a predetermined signal line non-active, the signal processing circuit interrupts a pulse generated at a predetermined stage of the shift register but does not interrupt a pulse generated at a stage other than the predetermined stage.

Further, the display device of the present invention is adapted so that the display device includes the driving circuit of the display device.

As the foregoing discusses, in the driving circuit of the display device in accordance with the present invention, it is possible even in partial-screen display to cause the shift register to shift up to a final stage to tap off a signal (generate a pulse), and to interrupt, at a lower stage of the shift register, a signal of the stages corresponding to the non-display area. Thus, it is not necessary even in partial-screen display to stop the shift register between a first stage and a last stage of the shift register. Therefore, no special stage (stage of different configuration) needs to be provided in an in-between section of the shift register to stop the shifting. Accordingly, signal defects such as phase shifts resulting from inclusion of a stage of different configuration are restrained, so that high-quality display becomes possible.

This is a circuit diagram showing a part of a configuration of a display device in accordance with Embodiment 1.

FIG. 2

This is a circuit diagram showing a part of a configuration of a display device in accordance with Embodiment 1.

FIG. 3

This is a timing diagram showing a relationship between an output of a shift register circuit and an output of a delay circuit, in accordance with Embodiment 1 (in wide display).

FIG. 4

This is a timing diagram showing a relationship between an output of a shift register circuit and an output of a delay circuit, in accordance with Embodiment 1 (in partial-screen display).

FIG. 5

This is a circuit diagram showing a configuration of a display device in accordance with Embodiment 1.

FIG. 6(*a*)

This is a circuit diagram showing a configuration of a delay circuit in accordance with Embodiments 1 and 2.

FIG. 6(*b*)

This is a circuit diagram showing a configuration of a delay circuit in accordance with Embodiments 1 and 2.

FIG. 7(*a*)

This is a timing diagram showing operation of a delay circuit in accordance with Embodiments 1 and 2.

FIG. 7(*b*)

This is a timing diagram showing operation of a delay circuit in accordance with Embodiments 1 and 2.

FIG. 8

This is a circuit diagram showing a configuration of a shift register circuit.

FIG. 9(*a*)

Figure 8:
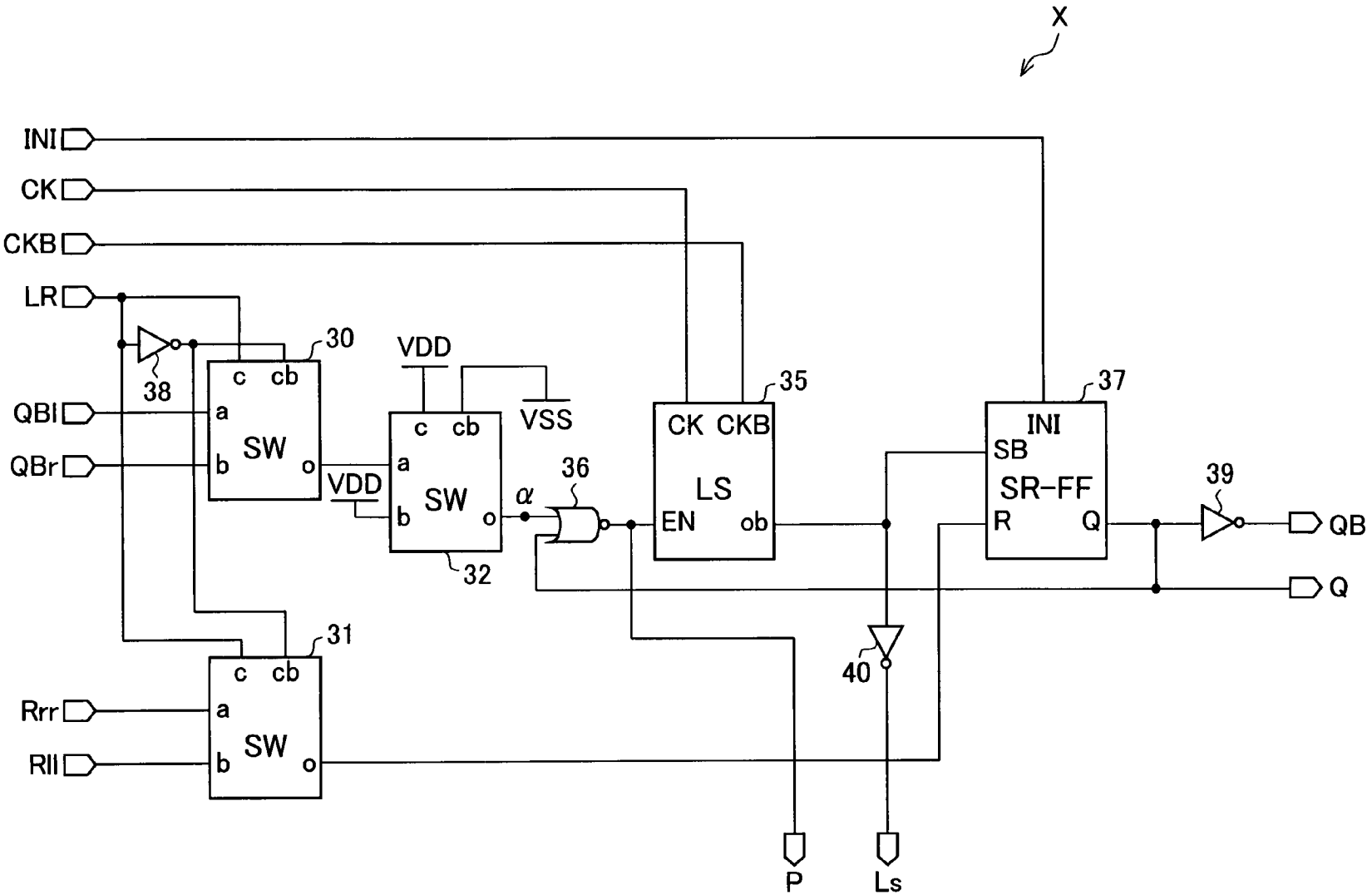

This is a timing diagram showing operation of the shift register circuit shown in FIG. 8.

FIG. 9(*b*)

This is a timing diagram showing operation of the shift register circuit shown in FIG. 8.

FIG. 10(*a*)

This is a timing diagram showing operation of the shift register circuit shown in FIG. 8.

FIG. 10(*b*)

This is a timing diagram showing operation of the shift register circuit shown in FIG. 8.

FIG. 11

This is a timing diagram showing operation of the shift register circuit shown in FIG. 8.

FIG. 12

This is a circuit diagram showing a configuration of a shift register circuit.

FIG. 13(*a*)

Figure 12:
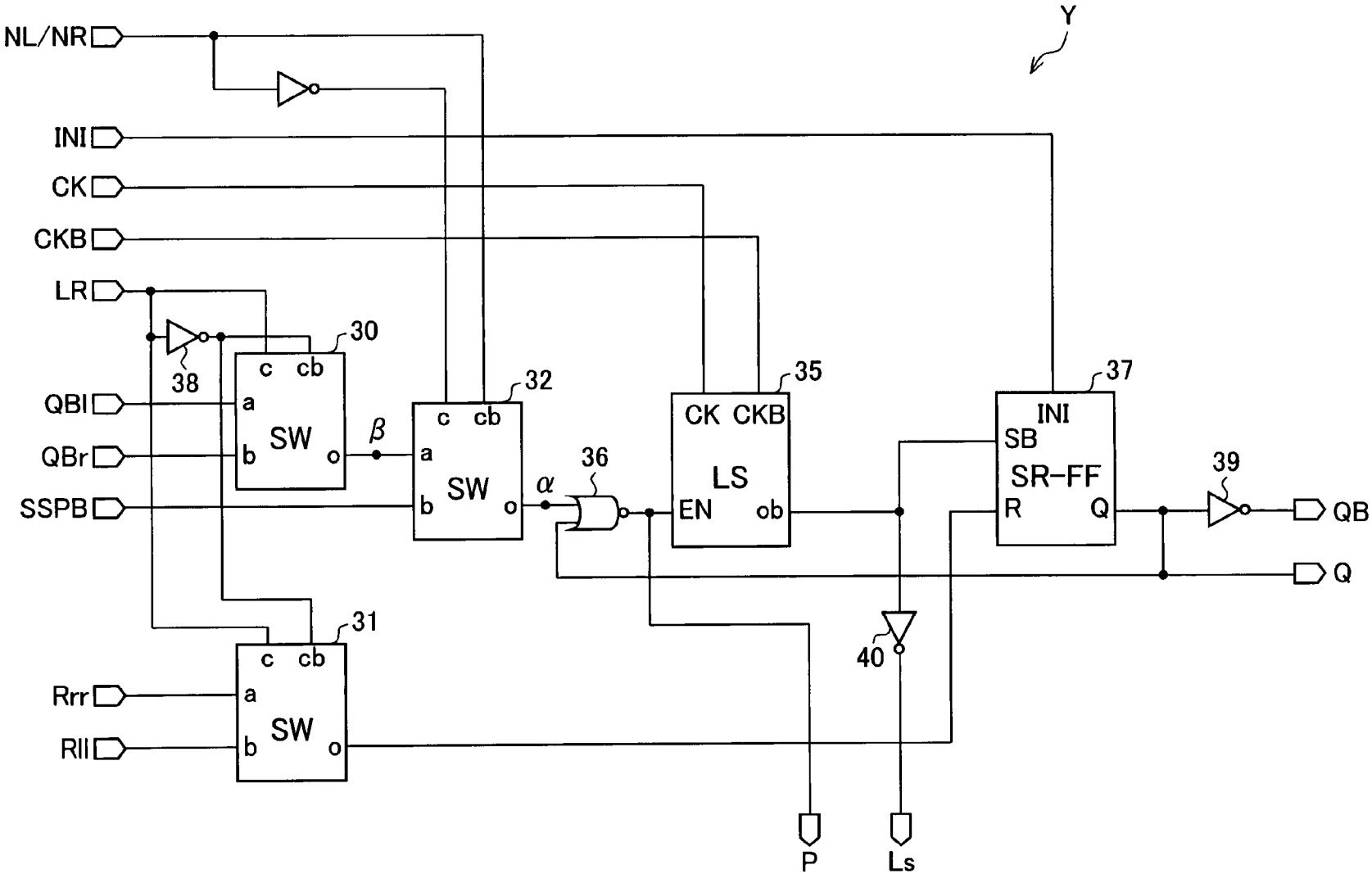

This is a timing diagram showing operation of the shift register circuit shown in FIG. 12.

FIG. 13(*b*)

This is a timing diagram showing operation of the shift register circuit shown in FIG. 12.

FIG. 14

This is a circuit diagram showing a configuration of a shift register circuit.

FIG. 15(*a*)

Figure 14:
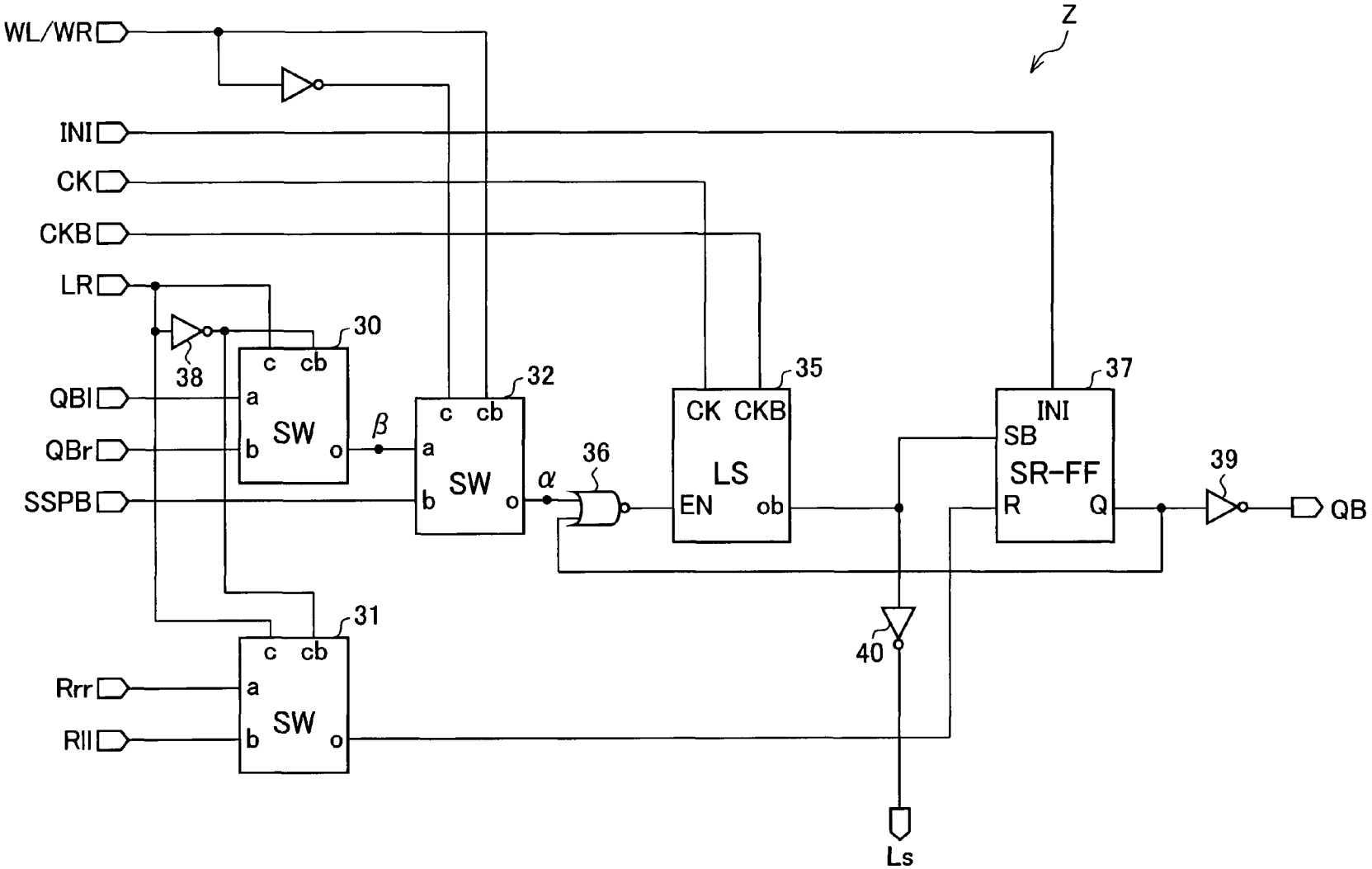

This is a timing diagram showing operation of the shift register circuit shown in FIG. 14.

FIG. 15(*b*)

This is a timing diagram showing operation of the shift register circuit shown in FIG. 14.

FIG. 16

This is a timing diagram showing operation of a shift register (in wide display).

FIG. 17

This is a timing diagram showing operation of a shift register (in partial-screen display).

FIG. 18

This is a circuit diagram showing a part of a configuration of a display device in accordance with Embodiment 2.

FIG. 19

This is a circuit diagram showing a part of a configuration of a display device in accordance with Embodiment 2.

FIG. 20

This is a circuit diagram showing a configuration of a display device in accordance with Embodiment 2.

FIG. 21

This is a circuit diagram showing a configuration of a shift register circuit.

FIG. 22(*a*)

Figure 21:
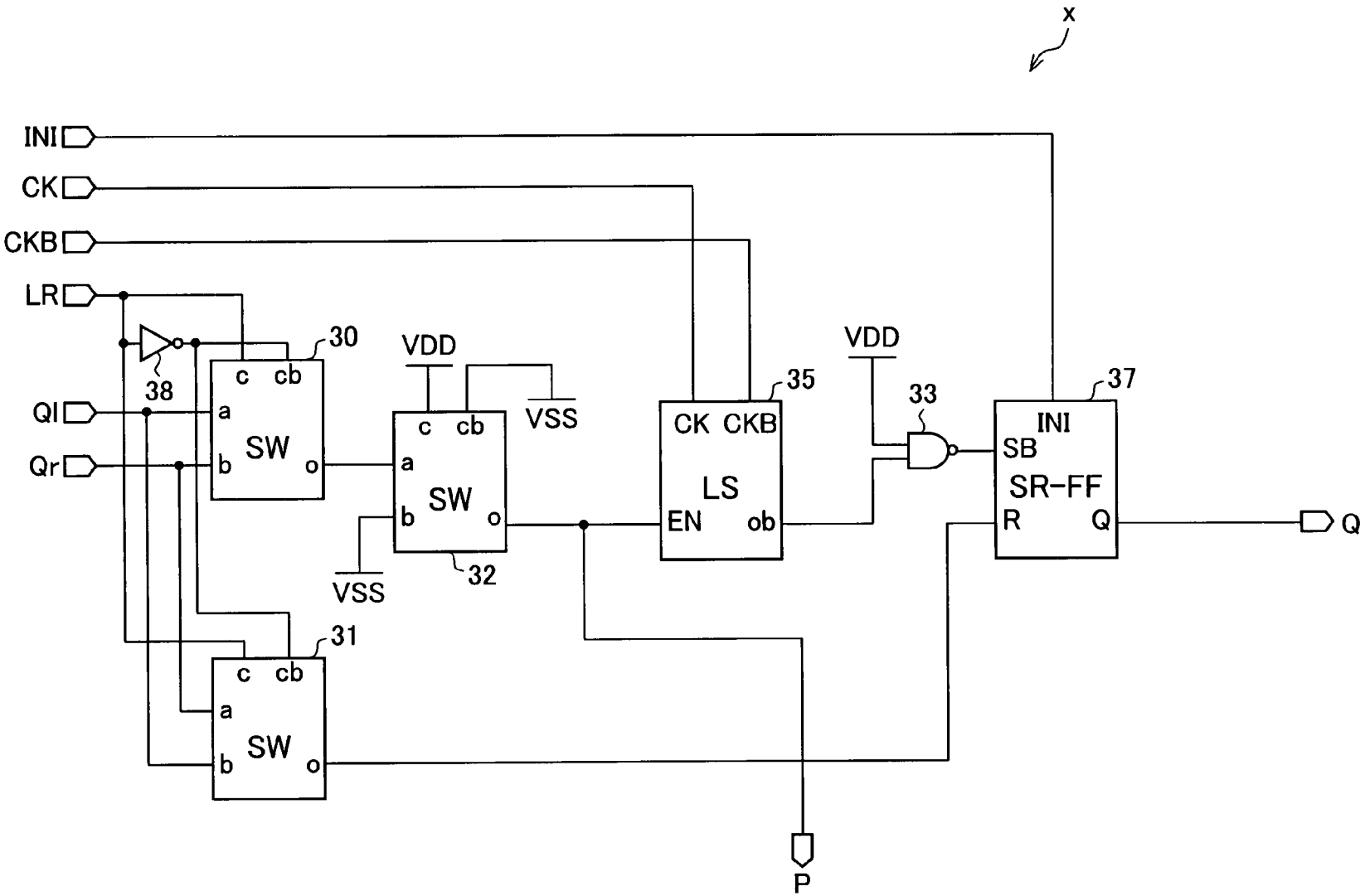

This is a timing diagram showing operation of the shift register circuit shown in FIG. 21.

FIG. 22(*b*)

This is a timing diagram showing operation of the shift register circuit shown in FIG. 21.

FIG. 23(*a*)

This is a timing diagram showing operation of the shift register circuit shown in FIG. 21.

FIG. 23(*b*)

This is a timing diagram showing operation of the shift register circuit shown in FIG. 21.

FIG. 24

This is a circuit diagram showing a configuration of a shift register circuit.

FIG. 25(*a*)

Figure 24:
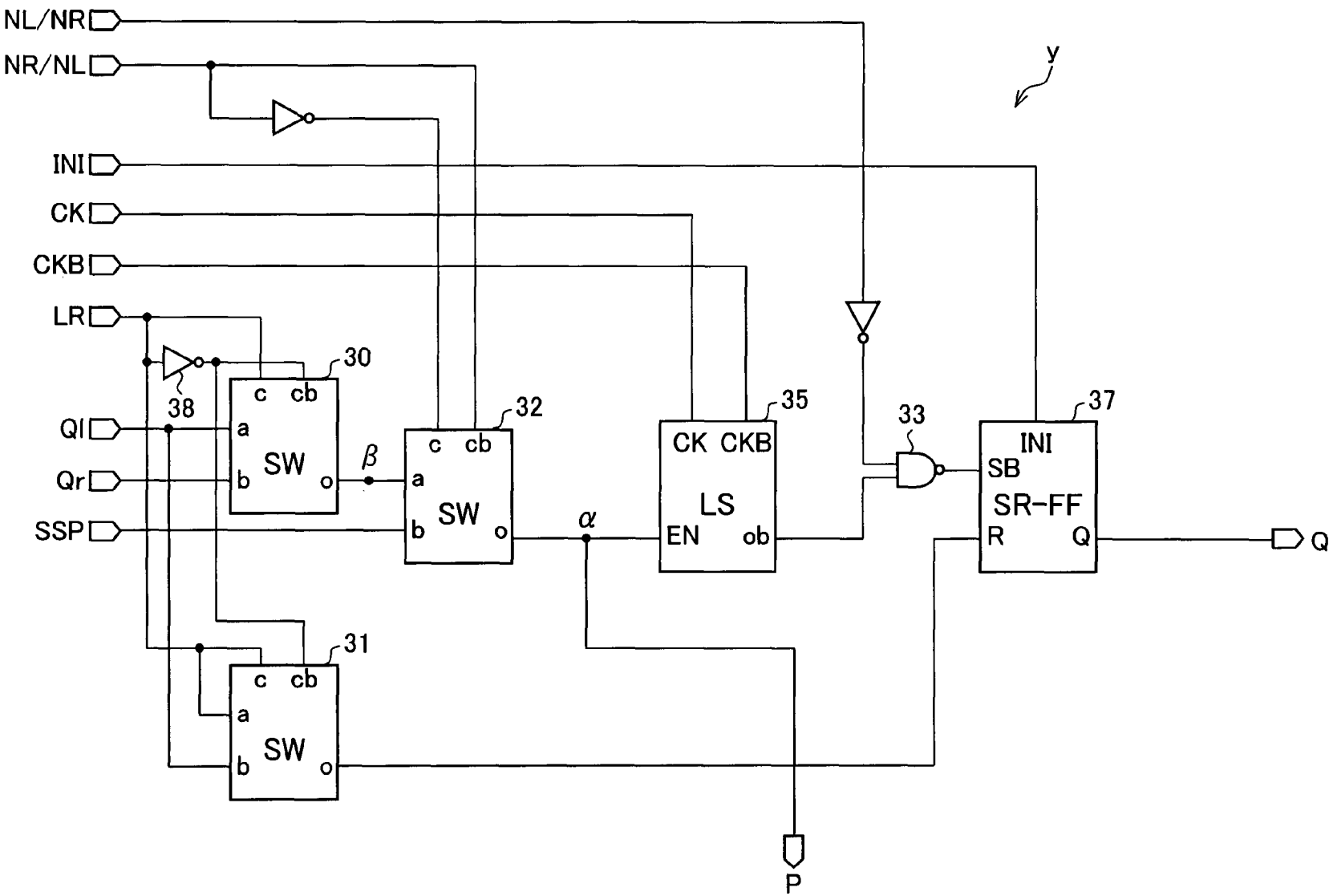

This is a timing diagram showing operation of the shift register circuit shown in FIG. 24.

FIG. 25(*b*)

This is a timing diagram showing operation of the shift register circuit shown in FIG. 24.

FIG. 26(*a*)

This is a timing diagram showing operation of the shift register circuit shown in FIG. 24.

FIG. 26(*b*)

This is a timing diagram showing operation of the shift register circuit shown in FIG. 24.

FIG. 27

This is a circuit diagram showing a configuration of a shift register circuit.

FIG. 28(*a*)

Figure 27:
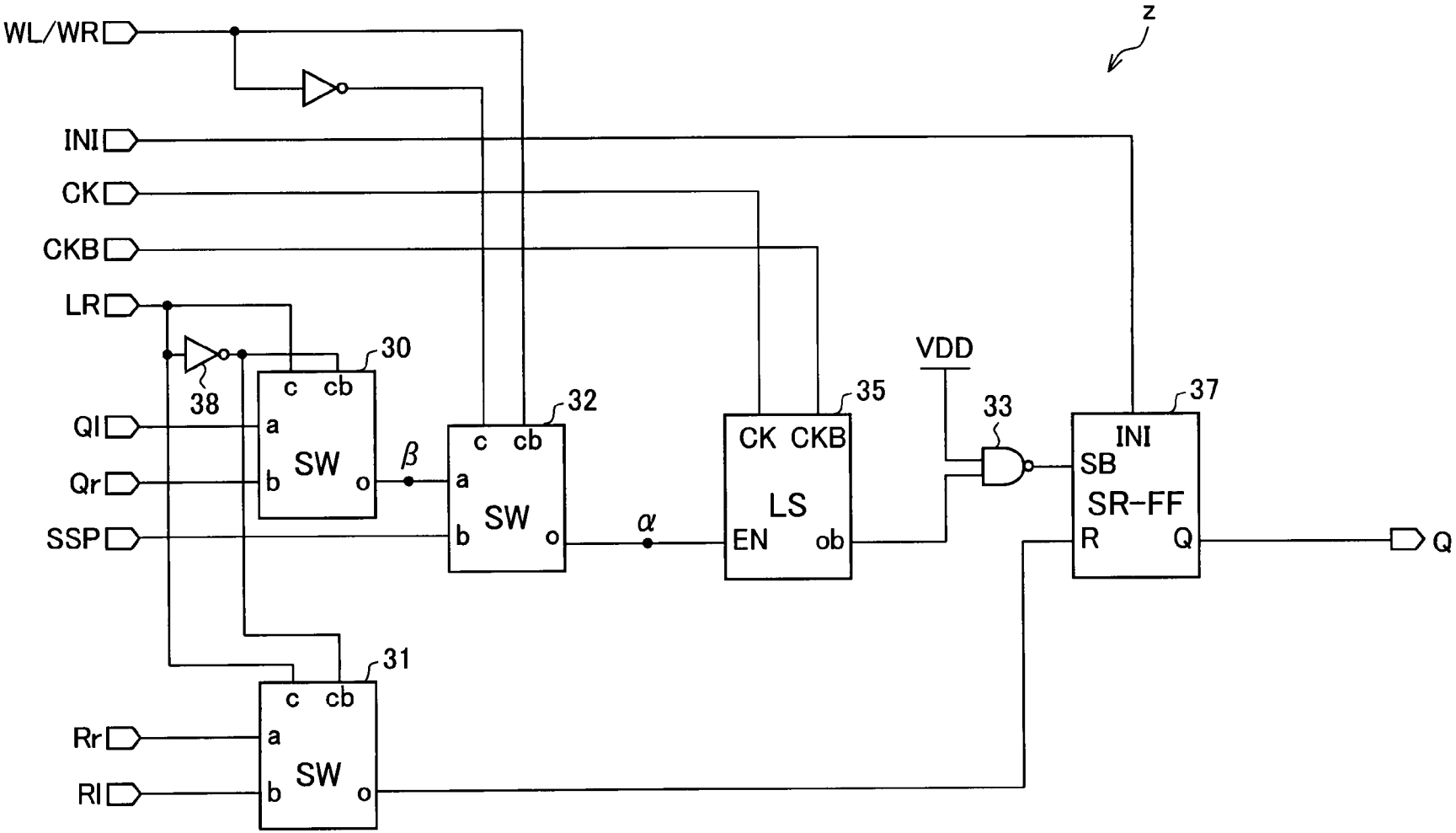

This is a timing diagram showing operation of the shift register circuit shown in FIG. 27.

FIG. 28(*b*)

This is a timing diagram showing operation of the shift register circuit shown in FIG. 27.

FIG. 29

This is a timing diagram showing operation of a shift register (in wide display).

FIG. 30

This is a timing diagram showing operation of a shift register (in partial-screen display).

FIG. 31(*a*)

This is a diagram showing a logic circuit to set a display mode and a shifting direction.

FIG. 31(*b*)

Figure 31:
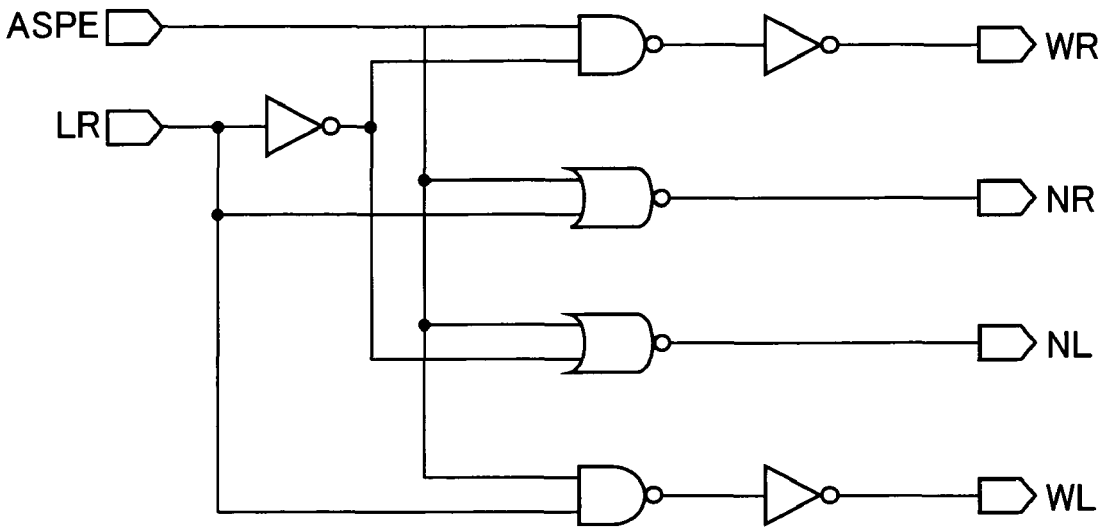

This is a truth table of the logic circuit shown in FIG. 31(*a*)

FIG. 32

This is a circuit diagram showing a configuration of an SR-FF (set-reset flip-flop).

FIG. 33

This is a circuit diagram showing a configuration of a level shifter.

FIG. 34(*a*)

This is a circuit diagram showing a configuration of a switch circuit that can replace the level shifter.

FIG. 34(*b*)

Figure 34:
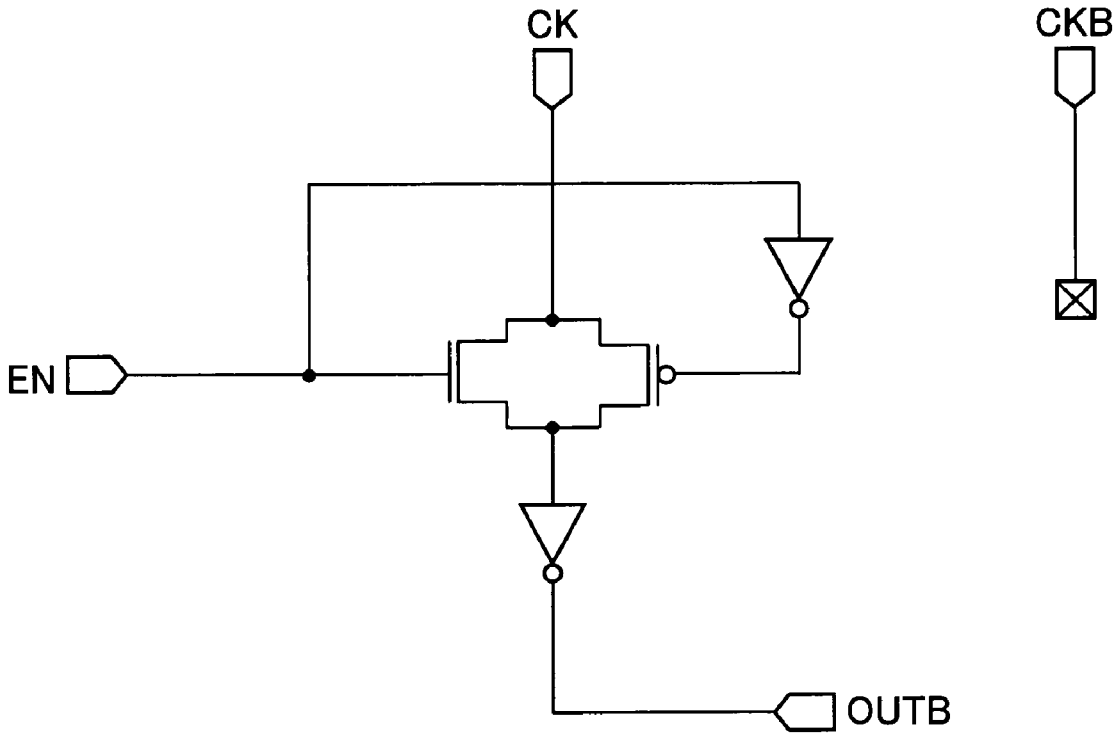
Figure 34:
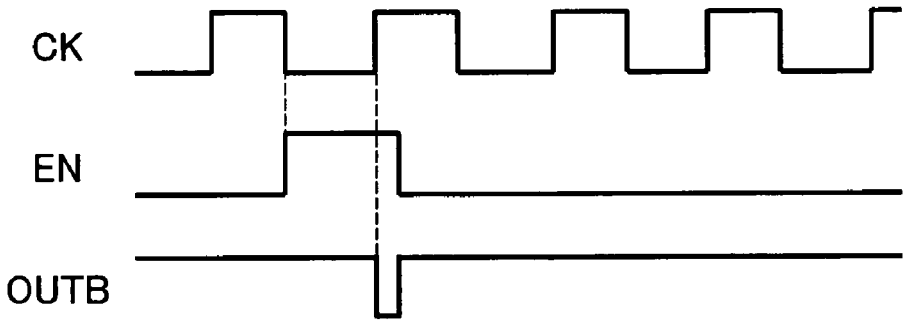

This is a timing diagram showing operation of the switch circuit shown in FIG. 34(*a*).

FIG. 35

This is a circuit diagram showing a configuration of a switch provided to the shift register circuit.

FIG. 36(*a*)

This is a circuit diagram showing a configuration of a precharge buffer circuit.

FIG. 36(*b*)

This is a circuit diagram showing a configuration of a data buffer circuit.

FIG. 37(*a*)

This is a circuit diagram showing a configuration of a sampling circuit.

FIG. 37(*b*)

Figure 37:
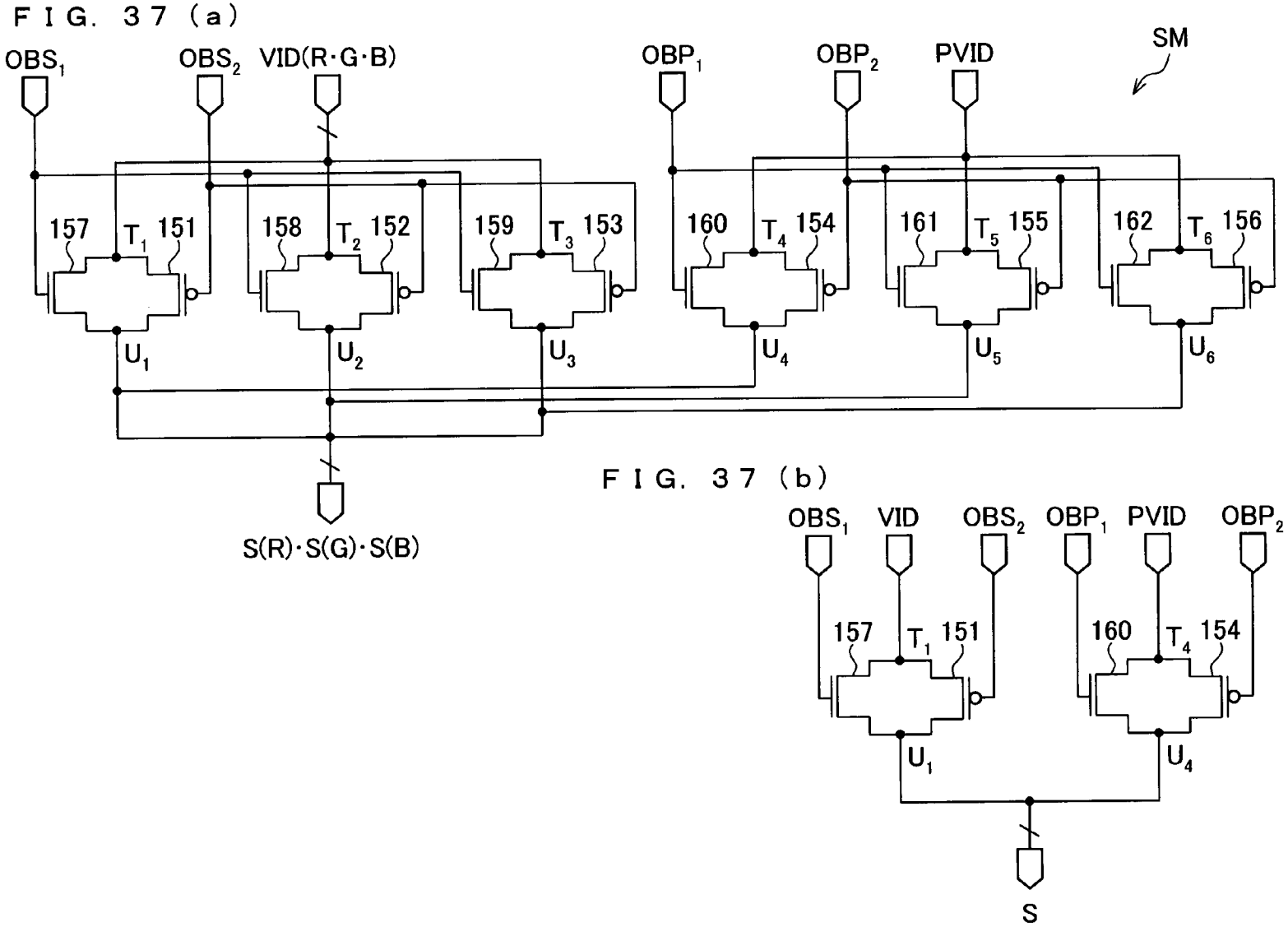

This is a circuit diagram showing a part of the sampling circuit shown in FIG. 37(*a*).

FIG. 38

This is a circuit diagram showing a configuration of a mask switch circuit.

FIG. 39

This is a circuit diagram showing a configuration of a conventional display device.

BEST MODE FOR CARRYING OUT THE INVENTION

Embodiment 1

Figure 1:
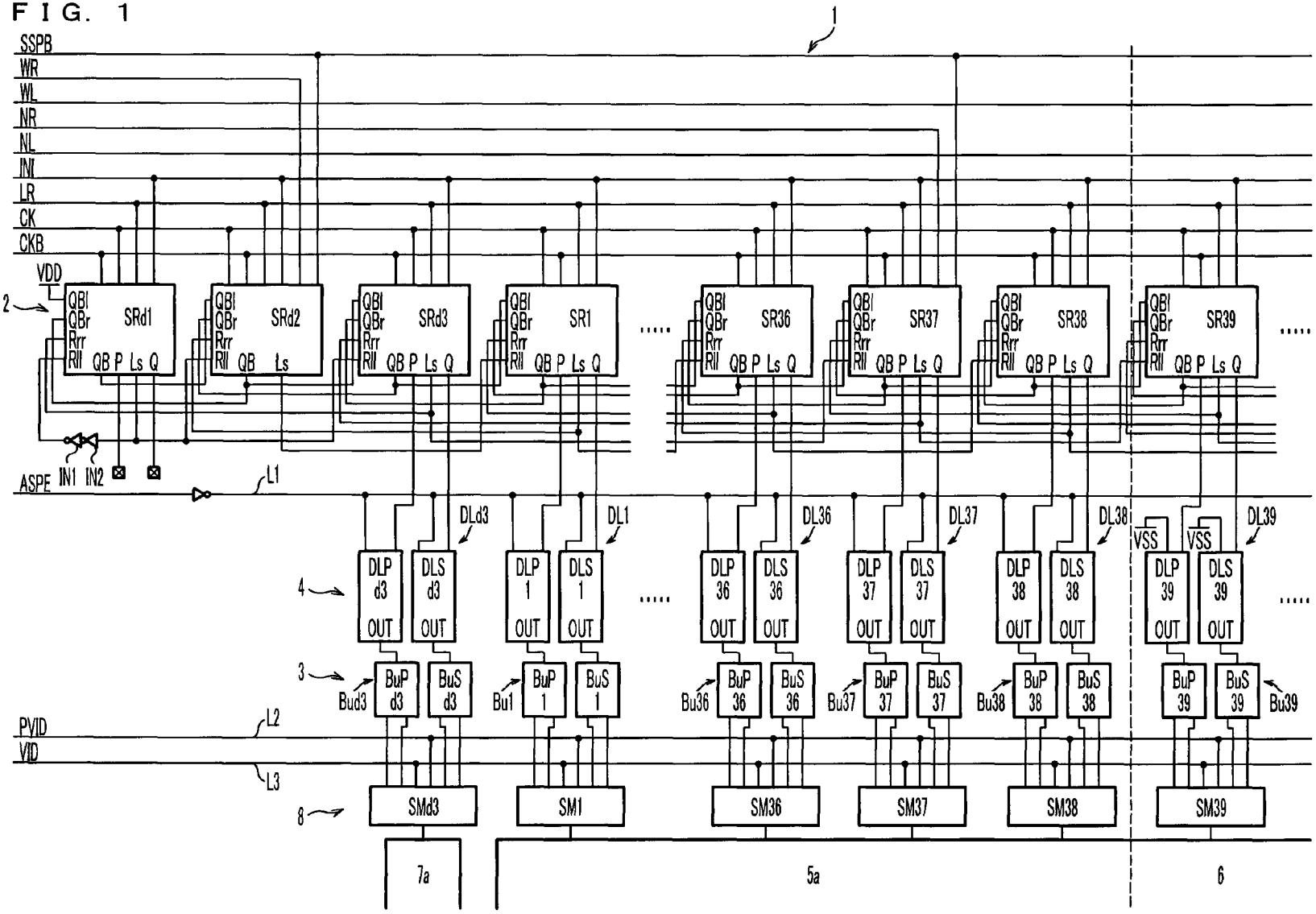
FIG. 1
Figure 2:
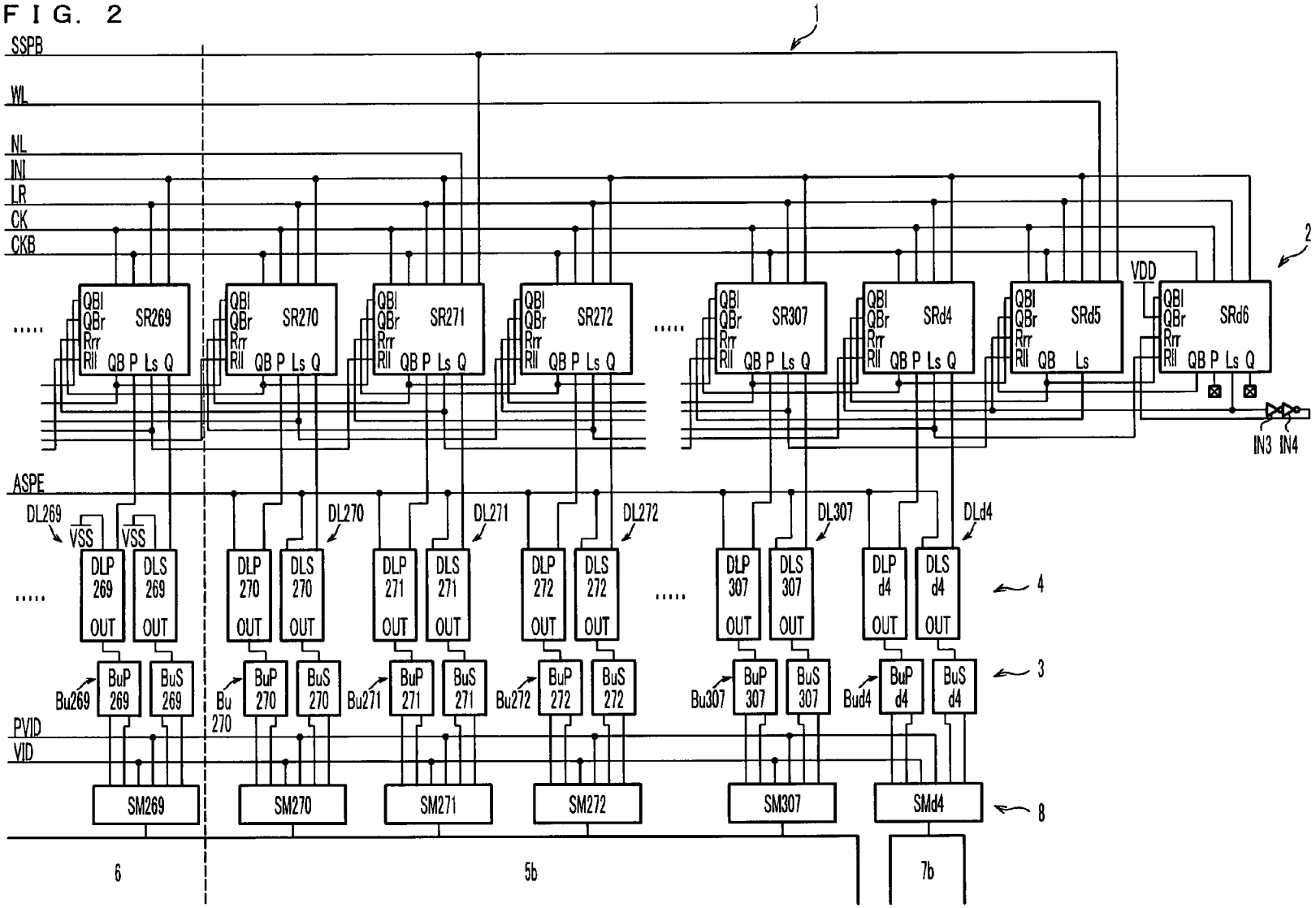
Figure 5:
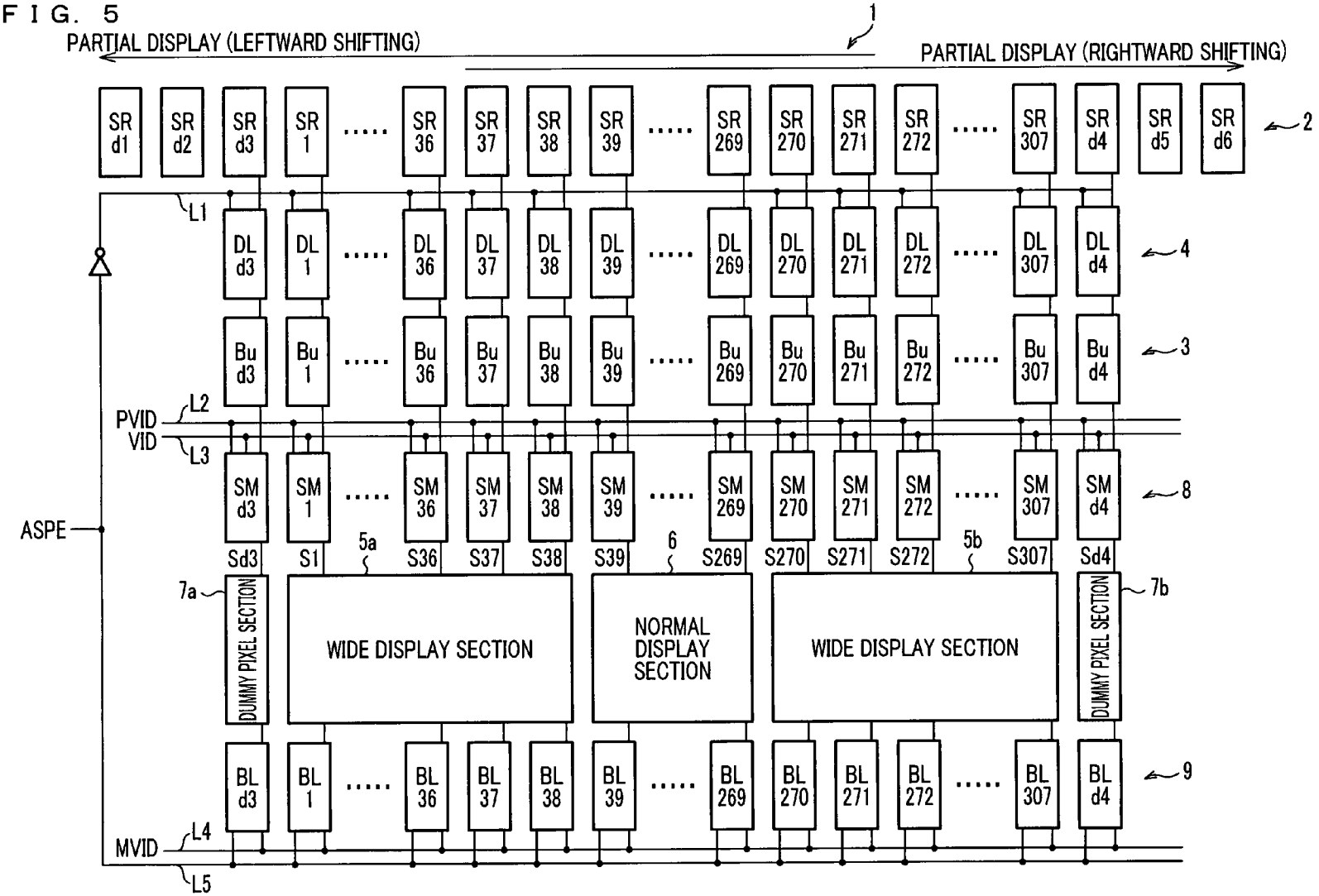

The following describes an embodiment of the present invention. FIGS. 1, 2, and 5 are circuit diagrams each showing a configuration of a display device 1 of Embodiment 1. The set of FIGS. 1 and 2 corresponds to FIG. 5. As shown in each of the figures, the display device 1 (e.g. liquid crystal display device) includes a source driver and a display section. The source driver includes a shift register 2, a delay circuit section 4, a buffer circuit section 3, a sampling circuit section 8, and a mask switch circuit section 9. The display section includes an output line S (Sd3, S1 to S307, and Sd4), a normal-display section 6, wide-display sections (mask section) 5*a* and 5*b*, and dummy pixel sections 7*a* and 7*b*. Illustration of connections between or among respective stages of the shift register 2 is omitted in FIG. 5.

The shift register 2 includes a plurality of shift-register stages (dummy stages SRd1 to SRd3, stages SR1 to SR307, and dummy stages SRd4 to SRd6 (in the order as provided, starting at an end)). The delay circuit section 4 includes a plurality of delay circuits (DLd3, DL1 to DL307, and DLd4 (in the order as provided, starting at an end)). The buffer circuit section 3 includes a plurality of buffer circuits (Bud3, Bu1 to Bu307, and Bud4 (in the order as provided, starting at an end)). The sampling circuit section 8 includes a plurality of sampling circuits (SMd3, SM1 to SM307, and SMd4 (in the order as provided, starting at an end)). The mask switch circuit section 9 includes a plurality of mask switch circuits (BLd3, BL1 to BL307, and BLd4 (in the order as provided, starting at an end)).

A shift-register stage Sri, a delay circuit Dli, a buffer circuit Bui, and a sampling circuit Smi are connected in this order, and a sampling circuit SMi is connected to an output line Si (i is an integer in the range of 1 to 307). In this manner, a shift-register stage SRd3, a delay circuit DLd3, a buffer circuit Bud3, a sampling circuit SMd3, and an output line Sd3 are connected. A shift-register stage SRd4, a delay circuit DLd4, a buffer circuit Bud4, a sampling circuit SMd4, and an output line Sd4 are connected in the same manner.

The display device 1 includes the following lines for input: L1 (ASPEB), L5 (ASPE), L2 (PVID), L3 (VID), and L4 (MVID); and SSPB, WR, WL, NR, NL, INI, LR, CK, and CKB. Each of SSPB, WR, WL, NR, NL, INI, and LR is fed as a signal with an electric potential of either High or Low of the operating voltage to drive the circuit. CK and CKB each have an amplitude smaller than the difference in electric potential between High and Low of the operating voltage to drive the circuit. Thus, CK and CKB need to be shifted in level, by a level shifter, to the operating voltage.

FIG. 31(*a*) is a logic circuit showing a relationship between input (ASPE, LR) and output (WL, WR, NL, NR). FIG. 31(*b*) is a truth table of the logic circuit. As shown in FIGS. 31(*a*) and 31(*b*), if ASPE and LR are both "H", only WL becomes "H", and the rest of outputs, namely WR, NL, and NR, each become "L". If ASPE is "H" and LR is "L", only WR becomes "H", and the rest of the outputs, namely WL, NL, and NR become "L". If ASPE is "L" and LR is "H", only NL becomes "H", and the rest of outputs, namely WL, WR, and NR become "L". If both ASPE and LR are "L", only NR becomes "H", and the rest of outputs, namely WR, WL, and NL, become "L".

Two wide-display sections 5*a* and 5*b* are each provided at respective sides of the normal-display section 6, which is provided at a central part of the screen, so as to sandwich the normal-display section 6. Two dummy pixel sections 7*a* and 7*b* are provided so as to sandwich the wide-display sections 5*a* and 5*b* and the normal-display section 6.

The sampling circuit SMd3 is connected to the dummy pixel section 7*a* via the output line Sd3. The sampling circuits SM1 to SM38 are connected to the wide-display section 5*a* via the output lines S1 to S38, respectively. The sampling circuits SM39 to SM269 are connected to the normal-display section 6 via the output lines S39 to S269, respectively. The sampling circuits SM270 to SM307 are connected to the wide-display section 5*b* via the output lines S270 to S307, respectively. The sampling circuit SMd4 is connected to the dummy pixel section 7*b* via the output line Sd4. The mask switch circuit BLd3 is connected to the dummy pixel section 7*a*. The mask switch circuits BL1 to BL38 are connected to the wide-display section 5*a*. The mask switch circuits BL39 to BL269 are connected to the normal-display section 6. The mask switch circuits BL270 to BL307 are connected to the wide-display section 5*b*. The mask switch circuit BLd4 is connected to the dummy pixel section 7*b*.

The shift register 2 is configured for double pulses. With the shift register 2, shifting in two directions is possible. Further, the shift register 2 performs shifting operation to divide the shift register by two to show a partial-screen display (only the normal-display section 6 shows a display). Specifically, in partial-screen display, if the shifting is rightward (see the arrows in the figure), the shift register circuits SR37 to SRd6 operate. If the shifting is leftward (see the arrows in the figure), the shift register circuits SR271 to SRd1 operate. Further, in wide display (the wide-display section 5 as well as the normal-display section 6 show a display), the shift register circuits SRd2 to SRd6 operate if the shifting is rightward, and the shift register circuits SRd5 to SRd1 operate if the shifting is leftward.

The following describes a configuration and operation of the respective shift register circuits.

FIG. 8 shows a configuration of the shift register circuits SRd1, SRd3, SR1 to SR36, SR38 to SR270, SR272 to 307, SRd4, and SRd6 (those shift register circuits will be referred to as a shift register circuit X hereinafter). As shown in this figure, the shift register circuit X includes a switch 30, a switch 31, a switch 32, a level shifter 35, a NOR 36, a set-reset flip-flop (the set-reset flip-flop will be referred to as an SR-FF hereinafter) 37, and three inverters 38, 39, 40. The shift register circuit X has eight input ends (CK, CKB, LR, INI, QBr, QB1, Rrr, R11) and four output ends (QB, P, Ls, Q). The switches (30 to 32) each have an input-a, an input-b, an input-c, an input-cb, and an output-o. The level shifter 35 is connected to the input ends CK and CKB, and has an input EN and an output-ob. The SR-FF 37 is connected to the input end INI, and has an input SB (set bar) and a reset R. An output of the SR-FF 37 is connected to an output end Q (of the shift register circuit X). The NOR 36 has two inputs. The inverters (38 to 40) each amplify a signal of positive logic to tap off a signal of negative logic as an output.

Figure 32:
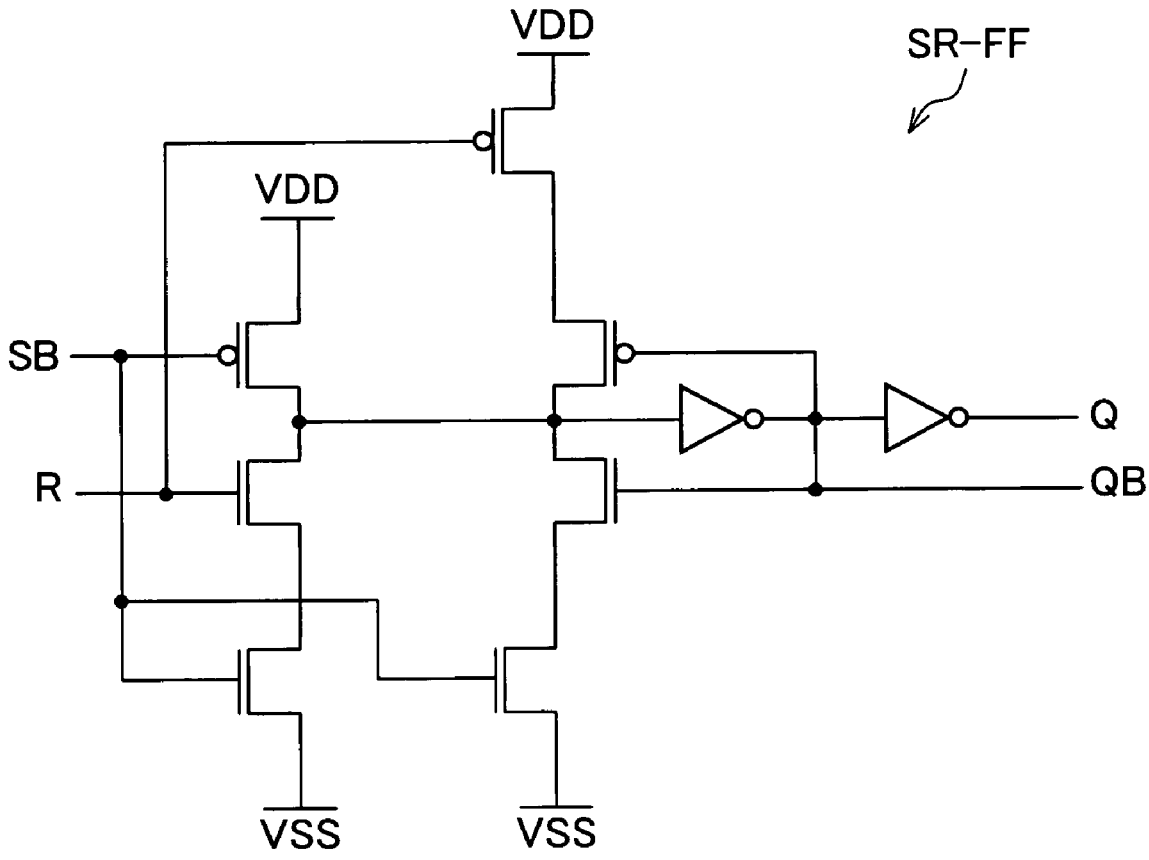

The set-reset flip-flop (SR-FF) provided to the shift register circuit SR is configured by the circuit shown in FIG. 32, for example. If "L" is fed into SB, then an output Q becomes "H (active)", and QB becomes "L (active)". If "H" is fed into a reset R, then the output Q becomes "L", and the output QB becomes "H".

Figure 33:
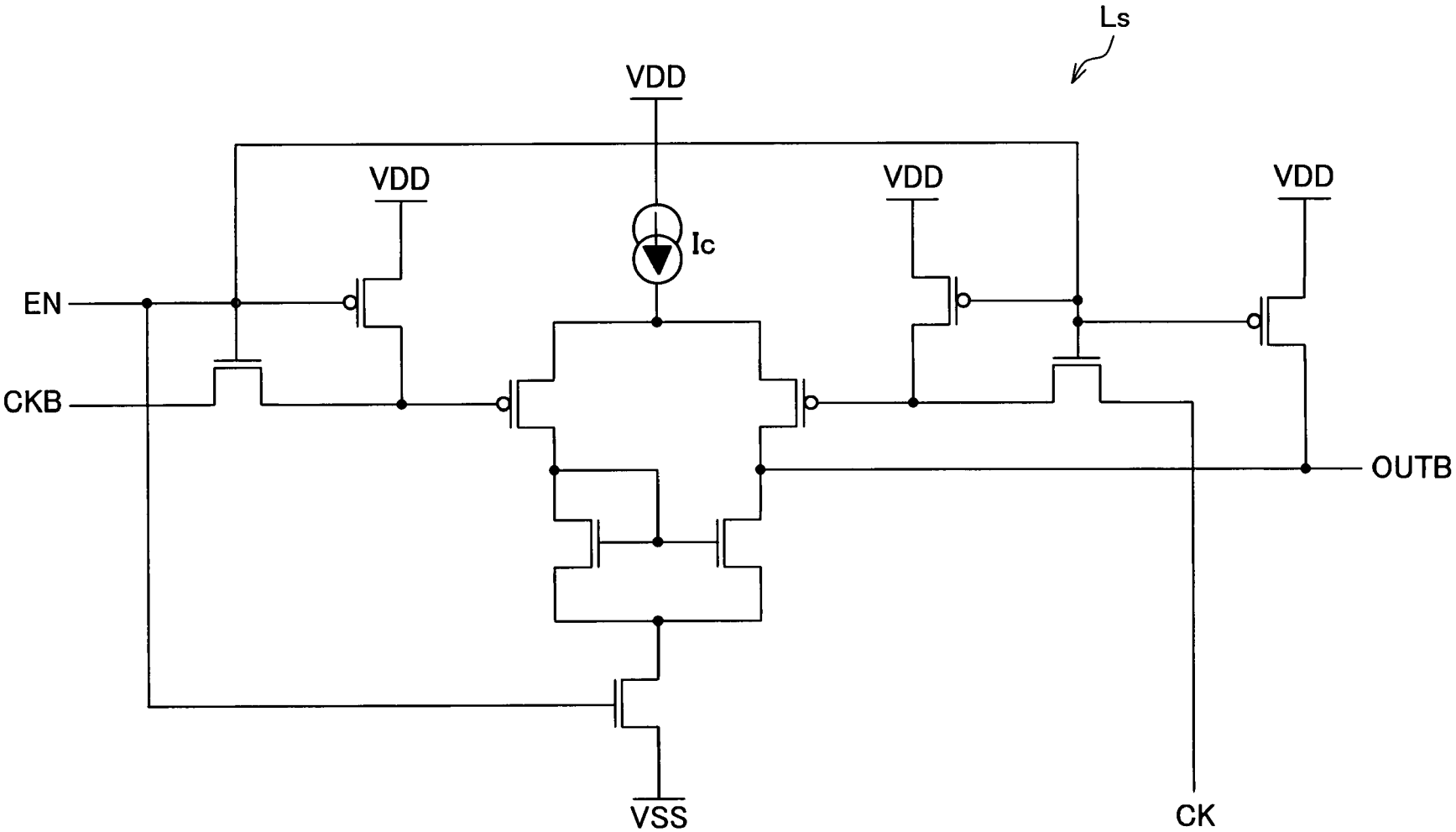

The level shifter provided to the shift register circuit SR is configured by the circuit shown in FIG. 33, for example. If EN is "H (active)", an inversion signal of an input clock (CK or CKB) is shifted in level and then tapped off from the output-ob. If EN is "L", "H" is tapped off.

Figure 35:
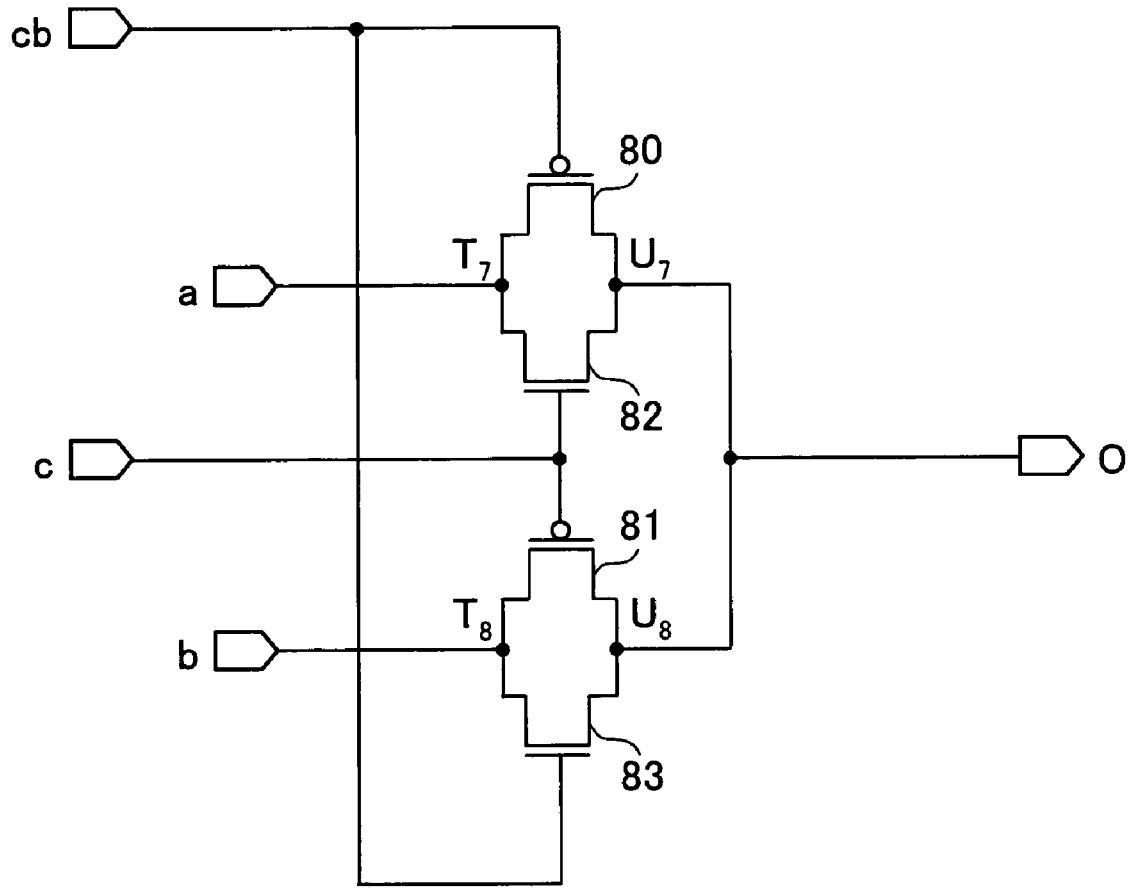

The switch SW (30, 31, 32) provided to the shift register circuit SR is configured as shown in FIG. 35, for example. A P-channel MOS transistor 80 and an N-channel MOS transistor 82 are coupled (a drain of one of the transistors and a source of the other one of the transistors are connected to form a terminal T7, and a source of that one of the transistors and a drain of that the other one of the transistors are connected to form a terminal U7). A P-channel MOS transistor 81 and an N-channel MOS transistor 83 are coupled (a drain of one of the transistors and a source of the other one of the transistors are connected to form a terminal T8, and a source of that one of the transistors and a drain of that the other one of the transistors are connected to form a terminal U8). The terminal T7 and the input-a are connected. The terminal T8 and the input-b are connected. A gate of the transistor 81, a gate of the transistor 82, and the input-c are connected. A gate of the transistor 80, a gate of the transistor 83, and the input-cb are connected. The terminal U7, the terminal U8, and the output-o are connected.

Back to FIG. 8, the input-a of the switch 30 is connected to the input end QB1. The input-b of the switch 30 is connected to the input end QBr. The input-c of the switch 30 is connected to the input end LR. The input-cb of the switch 30 is connected to an output of the inverter 38. An input of the inverter 38 is connected to LR. The input-a of the switch 31 is connected to Rrr. The input-b of the switch 31 is connected to R11. The input-c of the switch 31 is connected to the input end LR. The input-cb of the switch 31 is connected to the output of the inverter 38. The input-a of the switch 32 is connected to the output-o of the switch 30. The input-b of the switch 32 is connected to VDD. The input-c of the switch 32 is connected to VDD. The input-cb of the switch 32 is connected to VSS. The NOR 36 is fed with an output of the switch 32 and an output of the SR-FF 37. An output of the NOR 36 is connected to the input EN of the level shifter. The output-ob of the level shifter is connected to an input of the inverter 40 and the input SB (set bar) of the SR-FF 37. The reset R of the SR-FF 37 is connected to the output-o of the switch 31. An output of the SR-FF 37 is connected to an input of the inverter 39 and the output end Q of the shift register circuit X. Regarding other ends (ends other than the output end Q) of the shift register circuit X, QB is connected to an output of the inverter 39, Ls is connected to an output of the inverter 40, and P is connected to the output of the NOR 36.

Figure 9:
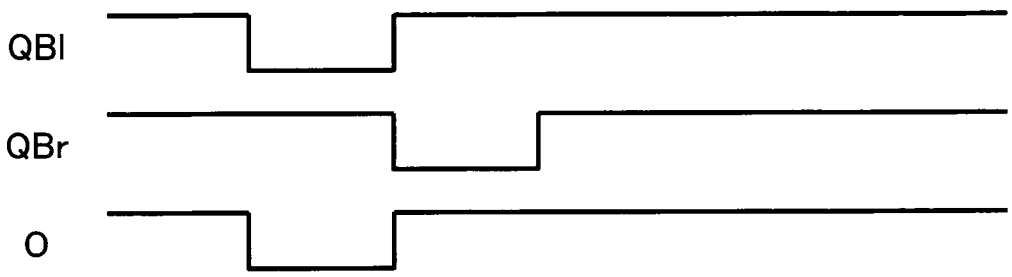
Figure 9:
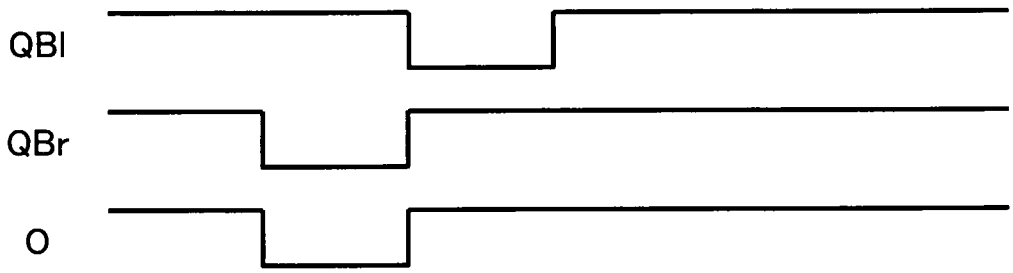

Operation of the switch 30 is as shown in FIGS. 9(*a*) and 9(*b*). If the input end LR of the shift register circuit X is "H (High)", a signal of the input end QB1 connected to the input-a is tapped off without being changed (see FIG. 9(*a*)). On the other hand, if the input end LR is "L (Low)", a signal of the input end QBr connected to the input-b is tapped off without being changed (see FIG. 9(*b*)).

Figure 10:
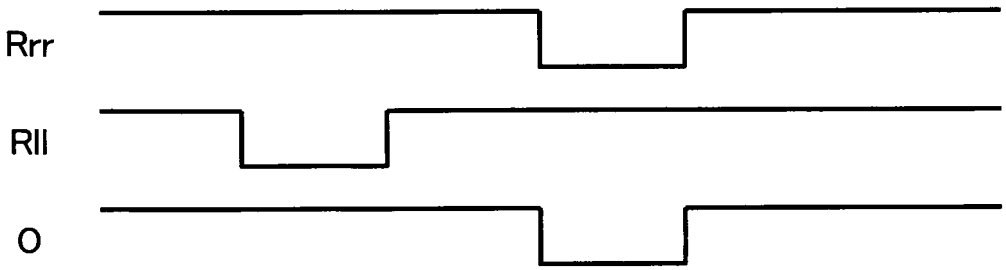
Figure 10:
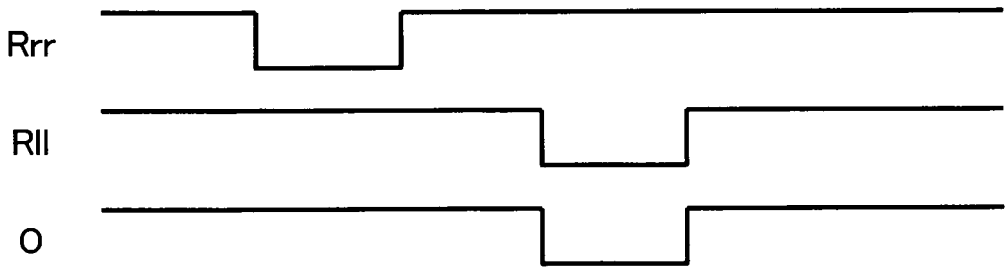

Operation of the switch 31 is as shown in FIGS. 10(*a*) and 10(*b*). Specifically, if the input end LR of the shift register circuit X is "H", a signal of the input end Rrr connected to the input-a is tapped off without being changed (see FIG. 10(*a*)). On the other hand, if the input end LR is "L", a signal of the input terminal R11 connected to the input-b is tapped off without being changed (see FIG. 10(*b*)). With regard to the switch 32, signals (pulse) fed to the input-a are tapped off without being changed (always ON). With regard to the SR-FF, "H" is tapped off if "L" is fed into the input SB, and "L" is tapped off if "H" is fed into the reset R.

Figure 11:
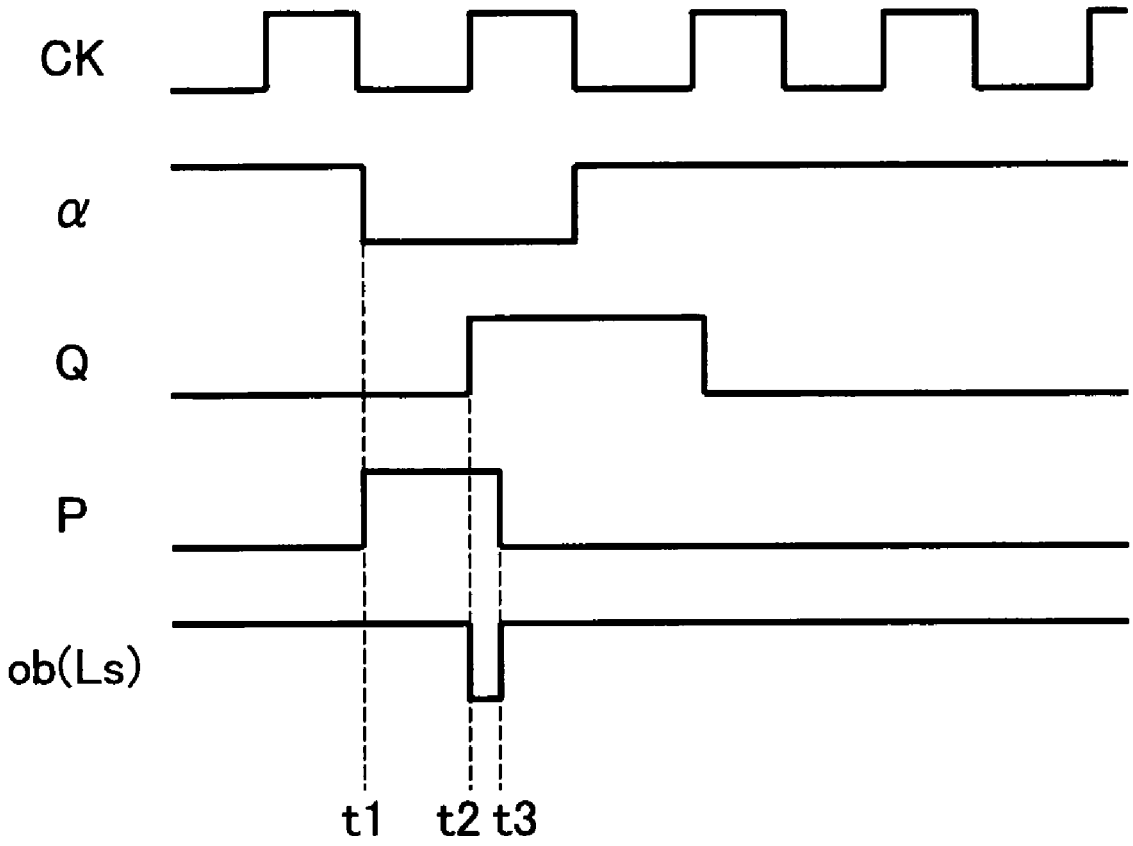

Operation of the NOR 36 and the level shifter 35 are as shown in FIG. 11. Specifically, if the output-o (node a) of the switch 32 becomes "L (active)" at t1, the output of the NOR 36 (the output end P of the shift register circuit X and the input EN of the level shifter) becomes "H (active)". Accordingly, CKB (inversion signal of CK) shifted in level is tapped off from the level shifter 35. Thus, if CKB becomes "L" at t2, the output-ob of the level shifter 35 becomes "L (active)", and "L" is fed into the input SB of the SR-FF 37. Therefore, the output (output end Q) becomes "H (active)". Because the output end Q is "H" (input of NOR 36), the output of the NOR 36 (the output end P of the shift register circuit X and the input EN of the level shifter 35) becomes "L" (inactive) at t3, which is delayed from t2. Thus, the output-ob of the level shifter 35 becomes "H (inactive)".

FIG. 12 shows a configuration of the respective shift register circuits SR37, SR271 (the shift register circuits will be referred to as a shift register circuit Y hereinafter). As shown in this figure, the shift register circuit Y is constituted by the same components as those of the shift register circuit X. Specifically, the shift register circuit Y is constituted by the switch 30, the switch 31, the switch 32, the level shifter 35, the NOR 36, the set-reset flip-flop (the set-reset flip-flop will be referred to as an SR-FF hereinafter) 37, and three inverters 38, 39, 40. The shift register circuit Y has ten input ends (NL/NR, CK, CKB, LR, SSPB, INI, QBr, QB1, Rrr, R11) and four output ends (QB, P, Ls, Q). SR37 has the input end NL, and SR271 has the input end NR. The switches (30 to 32) each have the input-a, the input-b, the input-c, the input-cb, and the output-o. The level shifter 35 is connected to the input ends CK and CKB, and has the input EN and the output-ob. The SR-FF 37 is connected to the input end INI, and has the input SB (set bar) and the reset R. The output of the SR-FF 37 is connected to the output end Q (of the shift register circuit Y).

The components of the shift register circuit Y are connected and operate in the same manner as in the shift register circuit X, except for the switch 32. Specifically, the input-b of the switch 32 of the shift register circuit Y is connected to the input end SSPB of the shift register circuit Y. The input end NL (in the case of SR37)/NR (in the case of SR271) of the shift register circuit Y is connected to the input-cb of the switch 32. The input end NL (in the case of SR37)/NR (in the case of SR271) is also connected to the input-c (of the switch 32) via an inverter. In the shift register circuit Y in partial-screen display (when ASPE is "L"), a start pulse (SSPB) fed into an in-between stage (SR37, SR271) of the shift register 1 is transmitted to the NOR 36, the level shifter 35, and the SR-FF 37 by the switch 32 so that shifting operation starts between a first stage and a last stage of the shift register.

Figure 13:
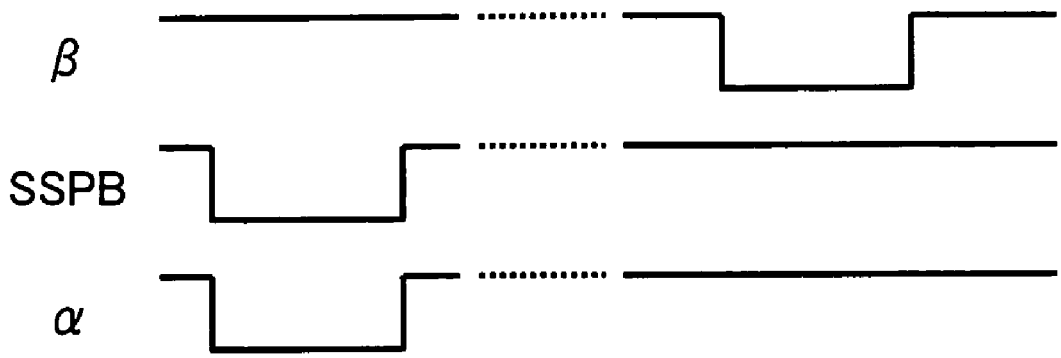
Figure 13:
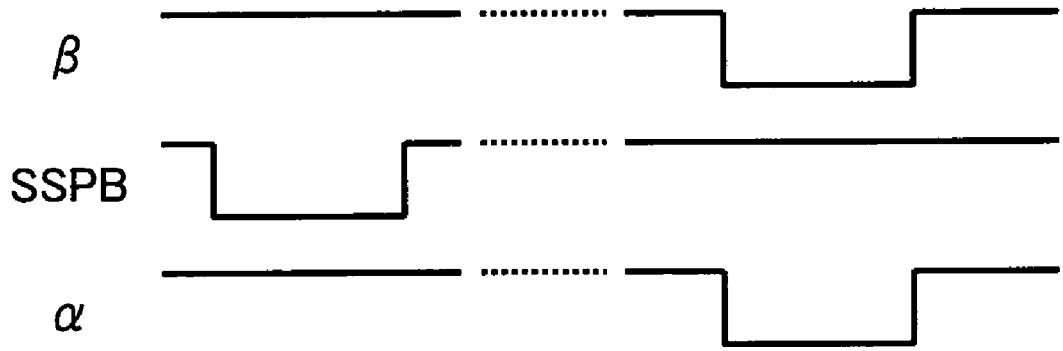

Operation of the switch 32 in the shift register circuit Y is as shown in FIGS. 13(*a*) and 13(*b*). If ASPE is "L" and NL is "H" (in the case of rightward shifting in partial-screen display), SSPB is fed into the node a (output of the switch 32) of SR37 without being changed. If ASPE is "L" and NR is "H" (in the case of leftward shifting in partial-screen display), SSPB is fed into the node a (output of the switch 32) of SR371 without being changed. On the other hand, if ASPE is "H" (wide display), NR and NL both become "L". At this time, SSPB is interrupted at both SR37 and SR271 so that a signal of node β (output-o of the switch 30) is tapped off to the node a (output-o of the switch 32) without being changed (this operation is same as that of the switch 32 of the shift register circuit X).

FIG. 14 shows a configuration of shift register circuits SRd2 and SRd5 (the shift register circuits will be referred to as a shift register circuit Z hereinafter). As shown in this figure, the components of the shift register circuit Z are same as those of the shift register circuit X. Specifically, the shift register circuit Z is constituted by the switch 30, the switch 31, the switch 32, the level shifter 35, the NOR 36, the set-reset flip-flop (the set-reset flip-flop will be referred to as an SR-FF hereinafter) 37, and three inverters 38, 39, 40. The shift register circuit Z has 10 input ends (WL/WR, CK, CKB, LR, SSPB, INI, QBr, QB1, Rrr, R11) and two output ends (QB, Ls). This stage does not need pulses for sampling the precharge PVID or the video signals VID, so that the output terminals P and Q are omitted, but in order to equalize the loads more precisely, the output terminals P and Q may be provided in the same manner as the other shift register circuits, and the delay circuit 4 may be connected as a dummy load in the same manner as the other stages. SRd2 has the input end WL, and SRd5 has the input end WR. The switches (30 to 32) each have the input-a, the input-b, the input-c, the input-cb, and the output-o. The level shifter is connected to the input ends CK, CKB, and has the input EN and the output-ob. The SR-FF 37 is connected to the input end INI, and has the input SB (set bar) and the reset R. The output of the SR-FF 37 is fed into the inverter 39 and the NOR 36.

The components of the shift register circuit Z are connected and operate in the same manner as in the shift register circuit X, except for the switch 32. Specifically, the input-b of the switch 32 of the shift register circuit Z is connected to the input end SSPB of the shift register circuit Z. The input end WL (in the case of SRd2)/WR (in the case of SRd5) of the shift register circuit Z is connected to the input-cb of the switch 32. input end WL (in the case of SRd2)/WR (in the case of SRd5) of the shift register circuit Z is also connected to the input-c (of the switch 32) via an inverter. In the shift register circuit Z in wide display (when ASPE is "H"), a start pulse (SSPB) having been fed into a dummy stage (SRd2, SRd5) of the shift register 1 is transmitted to the NOR 36, the level shifter 35, and the SR-FF 37 by the switch 32 to start the shifting from an end of the shift register.

Figure 15:
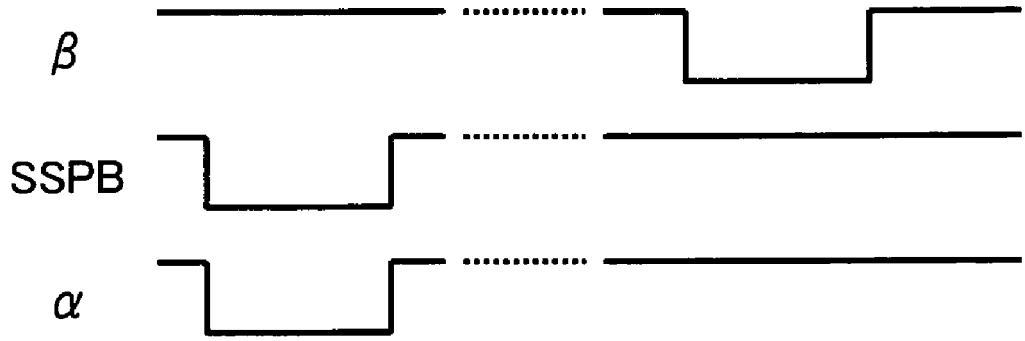
Figure 15:
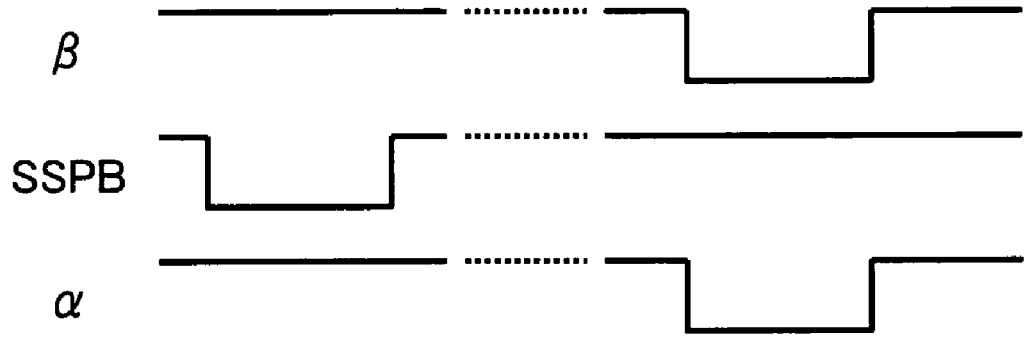

Operation of the switch 32 in the shift register circuit Z is as shown in FIGS. 15(*a*) and 15(*b*). If ASPE is "H" and WL is "H" (in the case of rightward shifting in wide display), SSPB is fed into the node α (output of the switch 32) of SRd2 without being changed. If ASPE is "H" and WR is "H" (in the case of the leftward shifting in wide display), SSPB is fed into the node a (output of the switch 32) of SRd5 without being changed. If ASPE is "L" (partial-screen display), WR and WL both become "L". At this time, SSPB is interrupted at both SRd2 and SRd5 so that signal of the node β (output-o of the switch 30) is tapped off to the node α (output-o of the switch 32) without being changed (this is the same operation as that of the switch 32 of the shift register circuit X).

The following describes how the shift register circuits are connected in the shift register 2 (see FIGS. 1 and 2).

For example, the shift register circuits SR37 and SR38 are respectively connected as follows. Regarding SR37, QB1 is connected to QB of SR36, QBr is connected to QB of SR38, Rrr is connected to Ls of SR39, R11 is connected to Ls of SR35, QB is connected to both QBr of SR36 and QB1 of SR38, P is connected to the precharge delay circuit DLP37, Ls is connected to both Rrr of SR35 and R11 of SR39, and Q is connected to the data delay circuit DLS37. Regarding SR38, QB1 is connected to QB of SR37, QBr is connected to QB of SR39, Rrr is connected to Ls of SR40, R11 is connected to Ls of SR36, QB is connected to both QBr of SR37 and QB1 of SR39, P is connected to the precharge delay circuit DLP38, Ls is connected to both Rrr of SR36 and R11 of SR40, and Q is connected to the data delay circuit DLS38.

Accordingly, the respective shift register circuits SRn (n is in the range of 1 to 307) shown in FIGS. 1 and 2 are connected as follows: QB1 is connected to QB of SRn−1 (shift register circuit on the left); QBr is connected to QB of SRn+1 (shift register circuit on the right); Rrr is connected to Ls of SRn+2 (shift register circuit next on the right but one); R11 is connected to Ls of SRn−2 (shift register circuit next on the left but one); QB is connected to QBr of SRn−1 (shift register circuit on the left) and QB1 of SRn+1 (shift register circuit on the right); P is connected to the precharge delay circuit DLPn; Ls is connected to Rrr of SRn−2 (shift register circuit next on the left but one) and R11 of SRn+2 (shift register circuit next on the right but one); and Q is connected to the data delay circuit DLSn. The same applies to the shift register circuits SRd3 and SRd4.

Regarding SRd1, QB1 is connected to VDD, QBr is connected to QB of SRd2, Rrr is connected to Ls of SRd3, R11 is connected to an output of the inverter IN1, QB is connected to QB1 of SRd2, and Ls is connected to an input of the inverter 2 connected serially to the inverter IN1, R11 of SRd2, and R11 of SRd3. Regarding SRd2, QB1 is connected to QB of SRd1, QBr is connected to QB of SRd3, Rrr is connected to Ls of SR1, R11 is connected to an input of the inverter IN2, QB is connected to QBr of SRd1 and QB1 of SRd3, and Ls is connected to R11 of SR1.

Regarding SRd5, QB1 is connected to QB of SRd4, QBr is connected to QB of SRd6, Rrr is connected to Rrr of SRd4 and Ls of SRd6, R11 is connected to Ls of SR307, QB is connected to QBr of SRd4 and QB1 SRd6, and Ls is connected to Rrr of SR307. Regarding SRd6, QB1 is connected to QB of SRd5, QBr is connected to VDD, Rrr is connected to an output of the inverter IN4 connected serially to the inverter IN3, R11 is connected to Ls of SRd4, QB is connected to QBr of SRd5, and Ls is connected to Rrr of SRd4, Rrr of SRd5, and an input of the inverter IN3.

Figure 6:
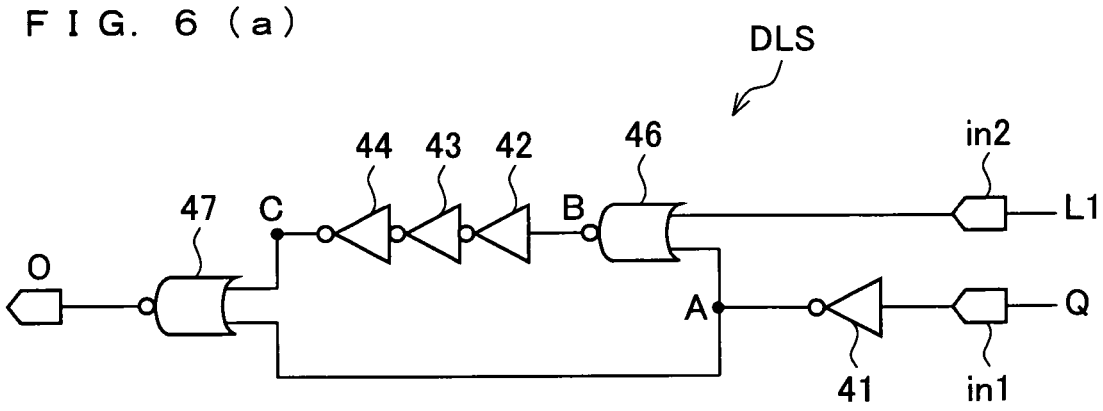
Figure 6:
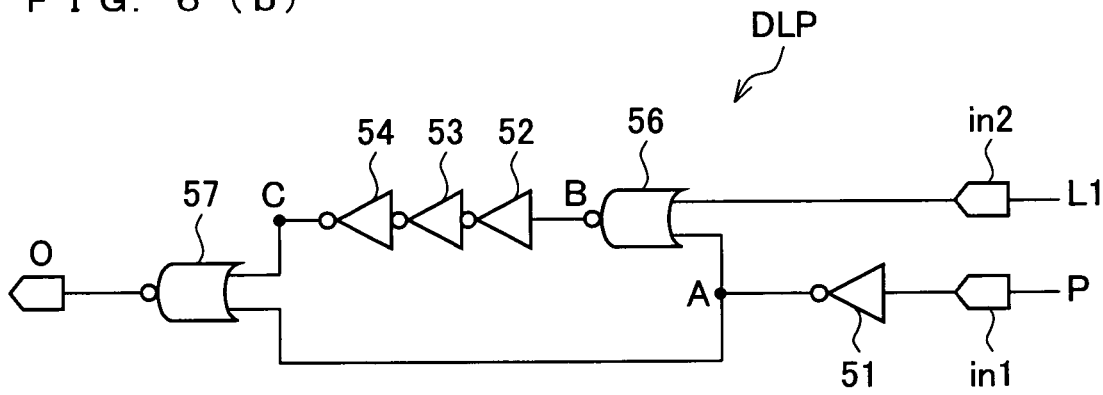

The following describes the delay circuit section 4, the buffer circuit section 3, and the sampling circuit section 8 (see FIGS. 1, 5, and 6). The delay circuits DL (DLd3, DL1 to DL307, and DLd4 (in the order as provided, starting at an end)) each include a precharge delay circuit DLP and a data delay circuit DLS. Specifically, a delay circuit D11 (i is an integer in the range of 1 to 307) includes a precharge delay circuit DLPi and a data delay circuit DLSi. A delay circuit DLd3 includes a precharge delay circuit DLPd3 and a data delay circuit DLSd3. The same applies to a delay circuit DLd4. The buffer circuits Bu each include a precharge buffer circuit BuP and a data buffer circuit BuS. Specifically, a buffer circuit Bui (i is an integer in the range of 1 to 307) includes a precharge buffer circuit BuPi and a data buffer circuit BuSi. A buffer circuit Bud3 includes a precharge buffer circuit BuPd3 and a data buffer circuit BuSd3. The same applies to a buffer circuit Bud4.

Here, the precharge delay circuits (DLPd3, DLP1 to DLP38, DLP270 to DLP307, DLPd4) corresponding to the wide-display sections 5*a* and 5*b* and the data delay circuits (DLSd3, DLS1 to DLS38, DLS270 to DLS307, DLPd4) corresponding to the wide-display section 5*a* and 5*b* are connected to the display-mode line L1. The precharge delay circuits (DLP39 to DLP269) corresponding to the normal-display section 6 and the data delay circuits (DLS39 to DLS269) corresponding to the normal-display section 6 are not connected to the display-mode line L1. An inversion signal of a display mode signal ASPE is transmitted to the line L1.

The precharge delay circuit DLP is connected to the sampling circuit SM via the precharge buffer circuit BuP. The data delay circuit DLS is connected to the sampling circuit SM via the data buffer circuit BuS. Specifically, a precharge delay circuit DLPi (i is an integer in the range of 1 to 307) is connected to a sampling circuit Smi via a precharge buffer circuit BuPi. A data delay circuit DLSi (i is an integer in the range of 1 to 307) is connected to a sampling circuit Smi via a data buffer circuit BuSi. A precharge delay circuit DLPd3 is connected to a sampling circuit SMd3 via a precharge buffer circuit BuPd3. A data delay circuit DLSd3 is connected to a sampling circuit SMd3 via a data buffer circuit BuSd3. The same applies to a precharge delay circuit DLPd4 and a data delay circuit DLSd4.

The sampling circuits SM (SMd3, SM1 to SM307, and SMd4 (in the order as provided, starting at an end)) are connected to the output lines (Sd3, S1 to S307, Sd4), respectively. Specifically, a sampling circuit Smi (i is an integer in the range of 0 to 307) is connected to an output line Si. The same applies to the sampling circuits SMd3 and SMd4. The sampling circuits SMd3 and SMd4 are connected to output lines Sd3 and Sd4, respectively. The respective sampling circuits SM are connected to the precharge line L2 and the video line L3. The precharge line L2 and the video line L3 are each fed with a precharge signal (electric potential) PVID and a video signal (electric potential) VID. The respective sampling circuits SM connect the output line S and the precharge line L2 in response to a signal from the precharge buffer circuit BuP, and connect the output line S and the video line L3 in response to a signal from the data buffer circuit BuS. With the foregoing arrangement, precharging and writing on video data are performed on the respective output lines (Sd3, S1 to S307, Sd4).

An exemplary configuration of the sampling circuit SM is shown in FIG. 37(*a*). In the sampling circuit SM, a P-channel MOS transistor 151 and an N-channel MOS transistor 157 are coupled (a drain of one of the transistors and a source of the other one of the transistors are connected to form a terminal T1, and a source of that one of the transistors and a drain of that the other one of the transistors are connected to form a terminal U1). A P-channel MOS transistor 152 and an N-channel MOS transistor 158 are coupled (a drain of one of the transistors and a source of the other one of the transistors are connected to form a terminal T2, and a source of that one of the transistors and a drain of that the other one of the transistors are connected to form a terminal U2). A P-channel MOS transistor 153 and an N-channel MOS transistor 159 are coupled (a drain of one of the transistors and a source of the other one of the transistors are connected to form a terminal T3, and a source of that one of the transistors and a drain of that the other one of the transistors are connected to form a terminal U3). A P-channel MOS transistor 154 and an N-channel MOS transistor 160 are coupled (a drain of one of the transistors and a source of the other one of the transistors are connected to form a terminal T4, and a source of that one of the transistors and a drain of that the other one of the transistors are connected to form a terminal U4). A P-channel MOS transistor 155 and an N-channel MOS transistor 161 are coupled (a drain of one of the transistors and a source of the other one of the transistors are connected to form a terminal T5, and a source of that one of the transistors and a drain of that the other one of the transistors are connected to form a terminal U5). A P-channel MOS transistor 156 and an N-channel MOS transistor 162 are coupled (a drain of one of the transistors and a source of the other one of the transistors are connected to form a terminal T6, and a source of that one of the transistors and a drain of that the other one of the transistors are connected to form a terminal U6). T1, T2, and T3 are connected to VID (R/G/B). Respective gates of the transistors 157 to 159 are connected to OBS1 (one of outputs of the data buffer circuit BuS). Respective gates of the transistors 151 to 153 are connected to OBS2 (the other one of the outputs of the data buffer circuit BuS). T4, T5, and T6 are connected to PVID. Respective gates of the transistors 160 to 162 are connected to OBP1 (one of outputs of the precharge buffer circuit BuP). Respective gates of the transistors 154 to 156 are connected to OBP2 (the other one of the outputs of the precharge buffer circuit BuP). U1 to U6 are connected to the output line S (R/G/B). In the case shown in FIG. 37(*a*), three VID (R/G/B) correspond to three output lines S (R/G/B). In the case shown in FIG. 37(*b*), one VID corresponds to one output line S. The foregoing is merely an exemplary case in which the number of transistors that open and close simultaneously by the respective signals OBS1, OBS2, OBP1, and OBP2 increases and decreases according to the number of output lines, and the preset invention is not limited to the case. For example, the number of VID (R1/G1/B1/ . . . /Rn/Gn/Bn) corresponding to 3n (n is an integer of 2 or greater) lines of the output line S (R1/G1/B1/ . . . /Rn/Gn/Bn) may be increased to 3n so that the number of transistors that are opened and closed simultaneously by the respective signals OBS1, OBS2, OBP1, and OBP2 becomes 3n.

FIG. 6(*a*) is a circuit diagram showing a configuration of the data delay circuit DLS (interrupting circuit) of the present embodiment. As shown in this figure, the data delay circuit DLS includes inverters 41 to 44, a NOR 46 having two inputs, and a NOR 47 having two inputs. The data delay circuit DLS has input ends in1 and in2 and an output end O. The inverters (41 to 44) each amplify a signal of positive logic to produce a signal of negative logic as an output. An input of the inverter 41 is connected to the input end in1. An output of the inverter 41 is connected to a first input of the NOR 46 and to a first input of the NOR 47. A second input of the NOR 46 is connected to the input end in2. An output of the NOR 46 is connected to an input of the inverter 42. An output of the inverter 42 is connected to an input of the inverter 43. An output of the inverter 43 is connected to an input of the inverter 44. An output of the inverter 44 is connected to a second input of the NOR 47. An output of the NOR 47 is connected to the output end O.

The input ends in1 of the data delay circuits (DLSd3, DLS1 to DLS307, DLSd4) are connected to Q of their corresponding shift register circuits (SRd3, SR1 to SR307, SRd4). Further, the input ends in2 of the data delay circuits (DLSd3, DLS1 to DLS38, DLS270 to DLS307, DLSd4) corresponding to the wide-display section are connected to the display-mode line L1. The input ends in2 of the data delay circuits (DLS39 to DLS269) corresponding to the normal-display section 6 are connected to VSS. The output ends O of the data delay circuits (DLSd3, DLS1 to DLS307, DLSd4) are connected to their corresponding data buffer circuits (BuSd3, BuS1 to BuS307, BuSd4).

In the data delay circuit DLS shown in FIG. 6(*a*), the NOR 46 is provided on the line of the delay section (the series of three inverters 42 to 44) in which delay occurs. Where to provide the NOR 46, however, is not limited to this position, and the NOR 46 may be provided on a line where no delay occurs.

FIG. 6(*b*) is a circuit diagram showing a configuration of the precharge delay circuit DLP (interrupting circuit) of the present embodiment. As shown in this figure, the precharge delay circuit DLP includes inverters 51 to 54, a NOR 56 having two inputs, and a NOR 57 having two inputs. The precharge delay circuit DLP has input ends in1 and in2 and an output end O. The inverters (51 to 54) each amplify a signal of positive logic to produce a signal of negative logic as an output. An input of the inverter 51 is connected to the input end in1. An output of the inverter 51 is connected to a first input of the NOR 56 and to a first input of the NOR 57. A second input of the NOR 56 is connected to the input end in2. An output of the NOR 56 is connected to an input of the inverter 52. An output of the inverter 52 is connected to an input of the inverter 53. An output of the inverter 53 is connected to an input of the inverter 54. An output of the inverter 54 is connected to a second input of the NOR 57. An output of the NOR 57 is connected to the output end O.

The input ends in1 of the precharge delay circuits (DLPd3, DLP1 to DLP307, DLPd4) are connected to P of their corresponding shift register circuits (SRd3, SR1 to SR307, SRd4), respectively. Further, the input ends in2 of the precharge delay circuits (DLPd3, DLP1 to DLP38, DLP270 to DLP307, DLPd4) corresponding to the wide-display section are connected to the display-mode line L1. The input ends in2 of the precharge delay circuits (DLP39 to DLP269) corresponding to the normal-display section 6 are connected to VSS. The output ends O of the precharge delay circuits (DLPd3, DLP1 to DLP307, DLPd4) are connected to their corresponding precharge buffer circuits (BuPd3, BuP1 to BuP307, BuPd4).

In the precharge delay circuit DLP shown in FIG. 6(*b*), the NOR 56 is provided on the line of the delay section (the series of three inverters 52 to 54). Where to provide the NOR 56, however, is not limited to this position, and the NOR 56 may be provided on a line where no delay occurs.

Figure 7:
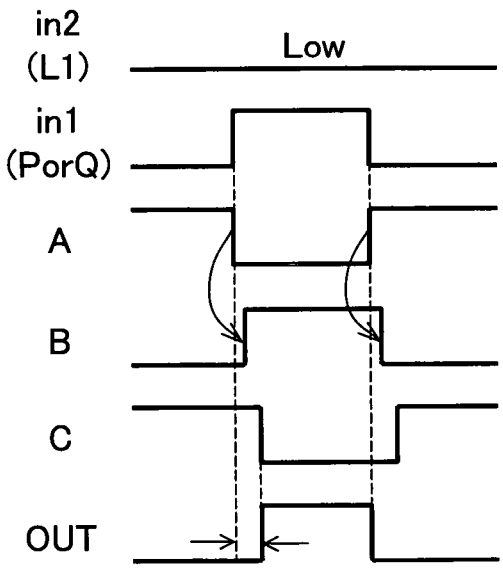
Figure 7:
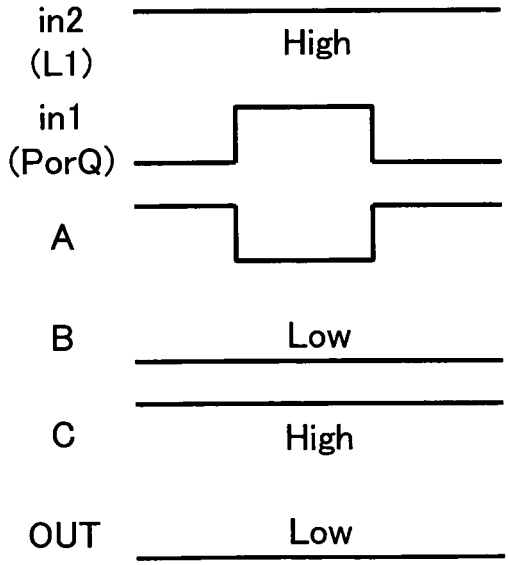

FIGS. 7(*a*) and 7(*b*) show the operation of the delay circuits DL (the precharge delay circuit and the data delay circuit) shown in FIGS. 6(*a*) and 6(*b*).

In FIG. 7(*a*), if the input end in2 is "L" (i.e. ASPE is "H", and the display-mode line L1 becomes "L", so that the partial-screen display signal is not fed), the delay circuit DL functions as a normal delay circuit. Specifically, if in1 connected to the shift register circuit SR becomes "H (active)", an output A of the inverter 41(51) becomes "L (active)". Lagging behind this event, an output B of the NOR 46(56) becomes "H (active)". Then, lagging behind an output of the NOR 46(56), an output C of the inverter 44(54) becomes "L (active)", and the output end O becomes "H (active)". Note that the NOR 46(56) and the NOR 47(57) do not affect delays in off-timings that cause sampling errors.

In FIG. 7(*b*), if the input end in2 is "H" (i.e. ASPE is "L", and the display-mode line L1 becomes "H", so that the partial-screen display signal is fed), the delay circuit DL functions as a pulse interrupting circuit. Specifically, if in1 connected to the shift register circuit SR becomes "H (active)", the output A of the inverter 41(51) becomes "L (active)", and the output B of the NOR 46(56) remains "L". Therefore, the output C of the inverter 44(54) remains "H", and the output end O also remains "L". Accordingly, if "H" is fed into the input end in2, a pulse of in1 is not transmitted to the output end O, and "L" is tapped off.

Figure 36:
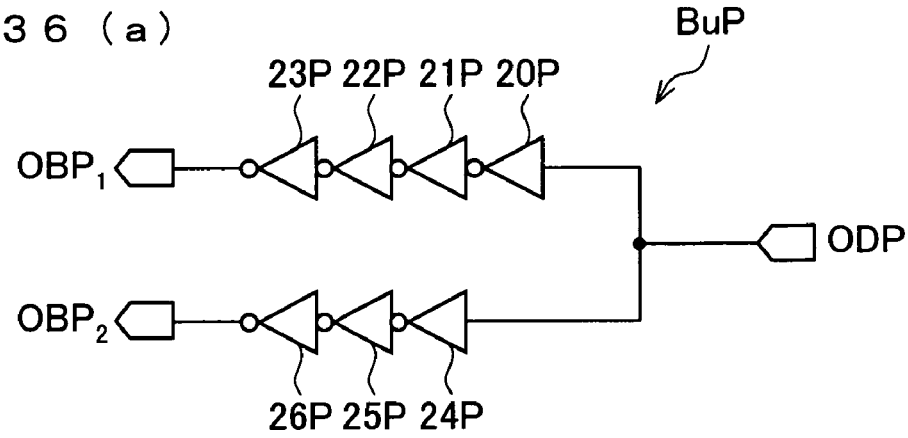
Figure 36:
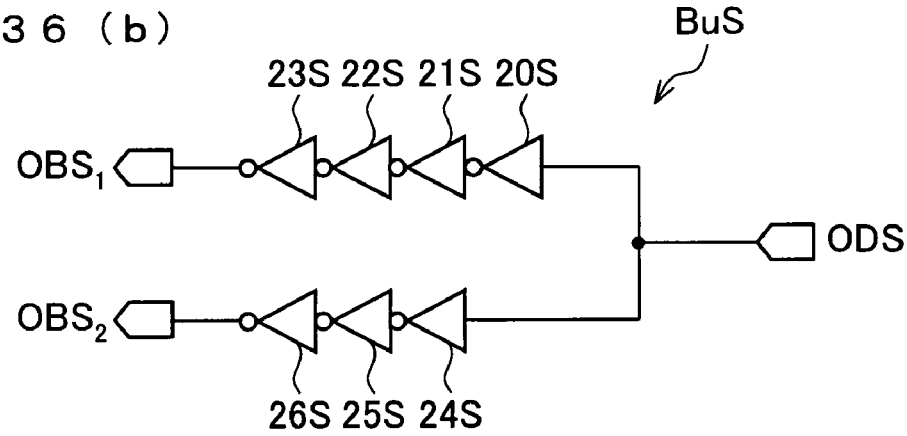

The buffer circuit Bu is configured as shown in FIGS. 36(*a*) and 36(*b*), for example. Specifically, in the precharge buffer circuit BuP, the output O of the delay circuit DLP is fed into an inverter 20P and into an inverter 24P. An output of the inverter 20P is fed into an inverter 21P. An output of the inverter 21P is fed into an inverter 22P. An output of the inverter 22P is fed into an inverter 23P. An output of the inverter 23P is an output OBP1. An output of the inverter 24P is fed into an inverter 25P. An output of the inverter 25P is fed into an inverter 26P. An output of the inverter 26P is an output OBP2. On the other hand, in the data buffer circuit BuS, the output O of the delay circuit DLS is fed into an inverter 20S and into an inverter 24S. An output of the inverter 20S is fed into an inverter 21S. An output of the inverter 21S is fed into an inverter 22S. An output of the inverter 22S is fed into an inverter 23S. An output of the inverter 23S is an output OBS1. An output of the inverter 24S is fed into an inverter 25S. An output of the inverter 25S is fed into an inverter 26S. An output of the inverter 26S is an output OBS2.

Figure 38:
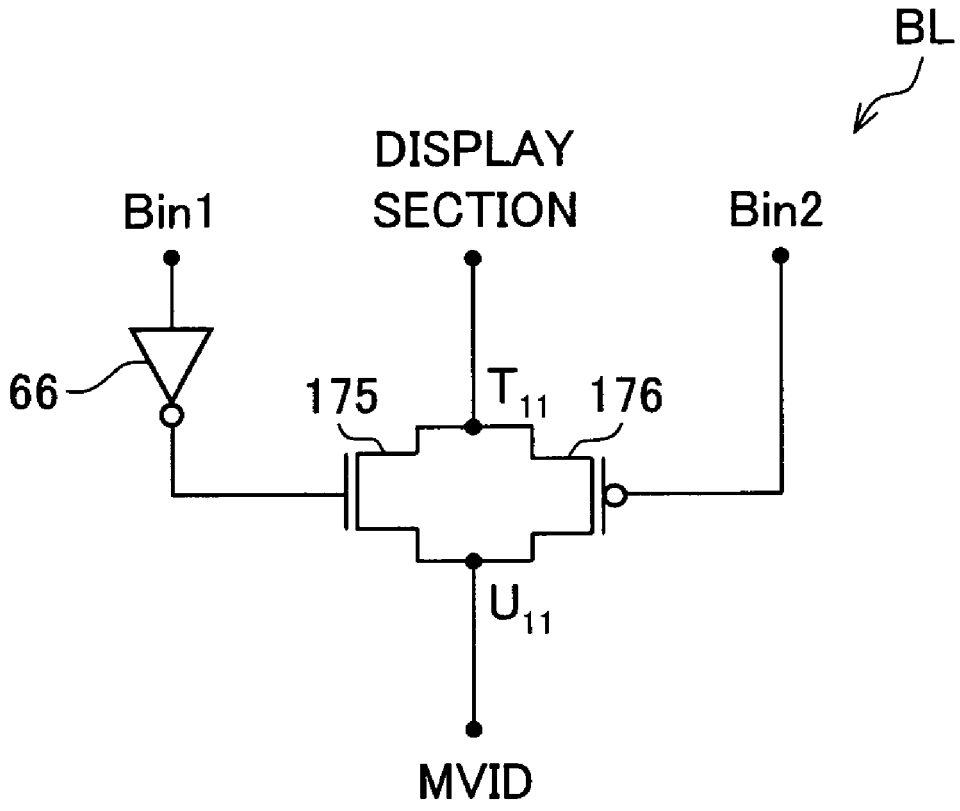
Figure 39:
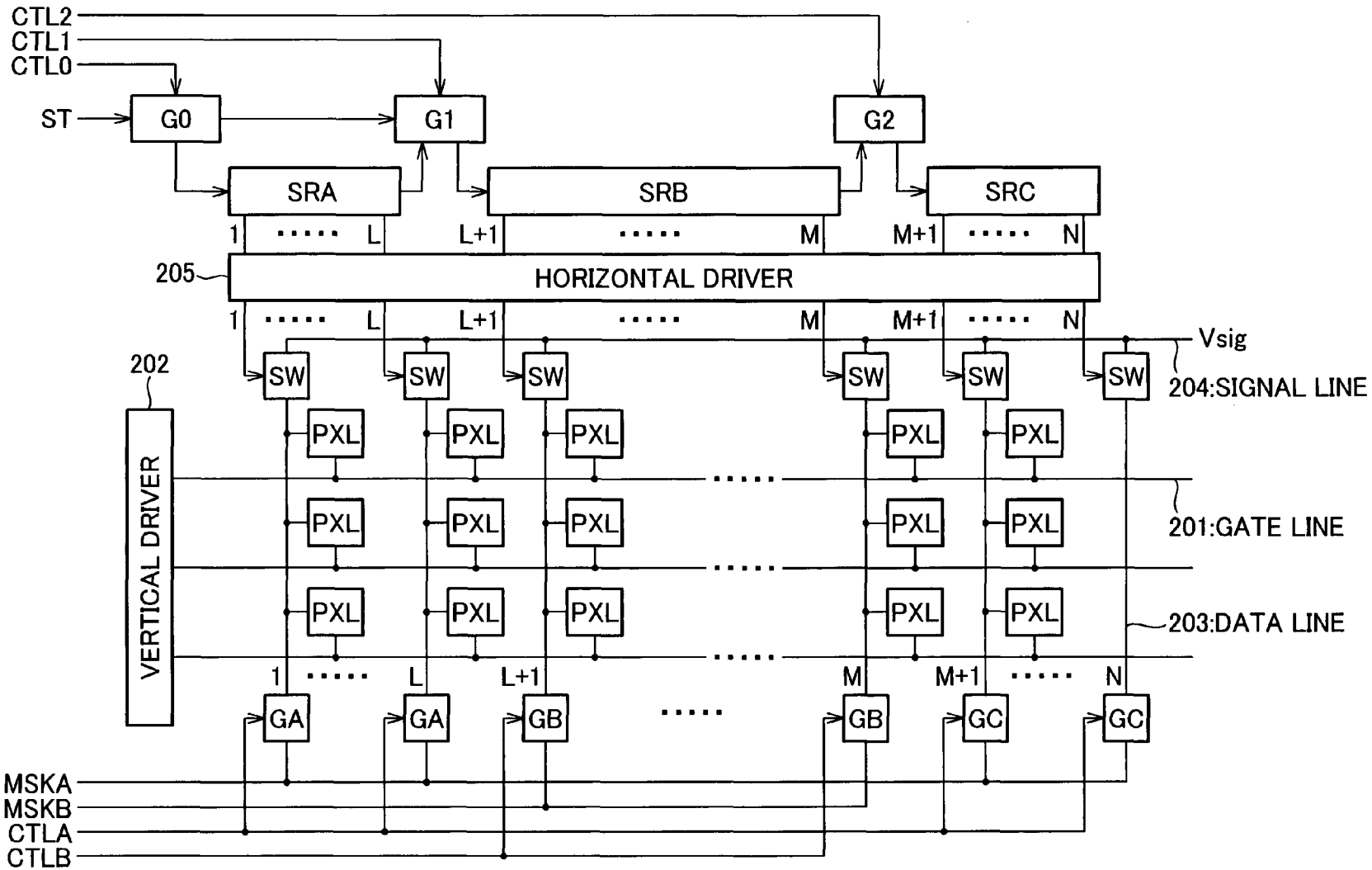

The following describes the mask switch circuits shown in FIG. 5. The mask switch circuits (BLd3, BL1 to 307, and BLd4) are analog switches. The mask switch circuits (BLd3, BL1 to 38, BL270 to 307, and BLd4) corresponding to the wide-display section 5 are connected to the mask line L4 and to the display-mode line L5. The mask switch circuits (BL39 to 269) corresponding to the normal-display section 6 are connected only to the mask line L4. The line L4 is fed with mask signal data MVID. The line L5 is fed with a display mode signal ASPE. During wide display (ASPEC is "H"), the mask switch circuits BL are all closed. On the other hand, in partial-screen display (ASPEC is "L"), the mask switch circuits connected to the wide-display sections 5*a* and 5*b* become ON, and the wide-display sections 5*a* and 5*b* are fed with the mask signal data MVID via the mask line L4. The mask switch circuit connected to the normal-display section 6 is connected so that the loads are equalized, although the mask switch circuit stays in an OFF state regardless of whether the display is the wide display or the partial-screen display. FIG. 38 shows an exemplary configuration of the mask switch circuit BL. Specifically, a P-channel MOS transistor 176 and an N-channel MOS transistor 175 are coupled (a drain of one of the transistors and a source of the other one of the transistors are connected to form a terminal T11, and a source of that one of the transistors and a drain of that the other one of the transistors are connected to form a terminal U11). An input Bin1 is connected to a gate of the transistor 175 via an inverter 66. An input Bin2 is connected to a gate of the transistor 176. T11 is connected to the display section. U11 is connected to MVID. With regard to the mask switch circuits BL corresponding to the wide-display sections 5*a* and 5*b* and to the dummy pixel sections 7*a* and 7*b*, Bin1 and Bin2 are connected to ASPE. With regard to the mask switch circuits BL corresponding to the normal-display section 6, Bin1 and Bin2 are connected to VDD. Further, the mask switch circuits BL are respectively connected to their data lines.

On the basis of the foregoing, the following describes the operation of the shift register 2.

Figure 16:
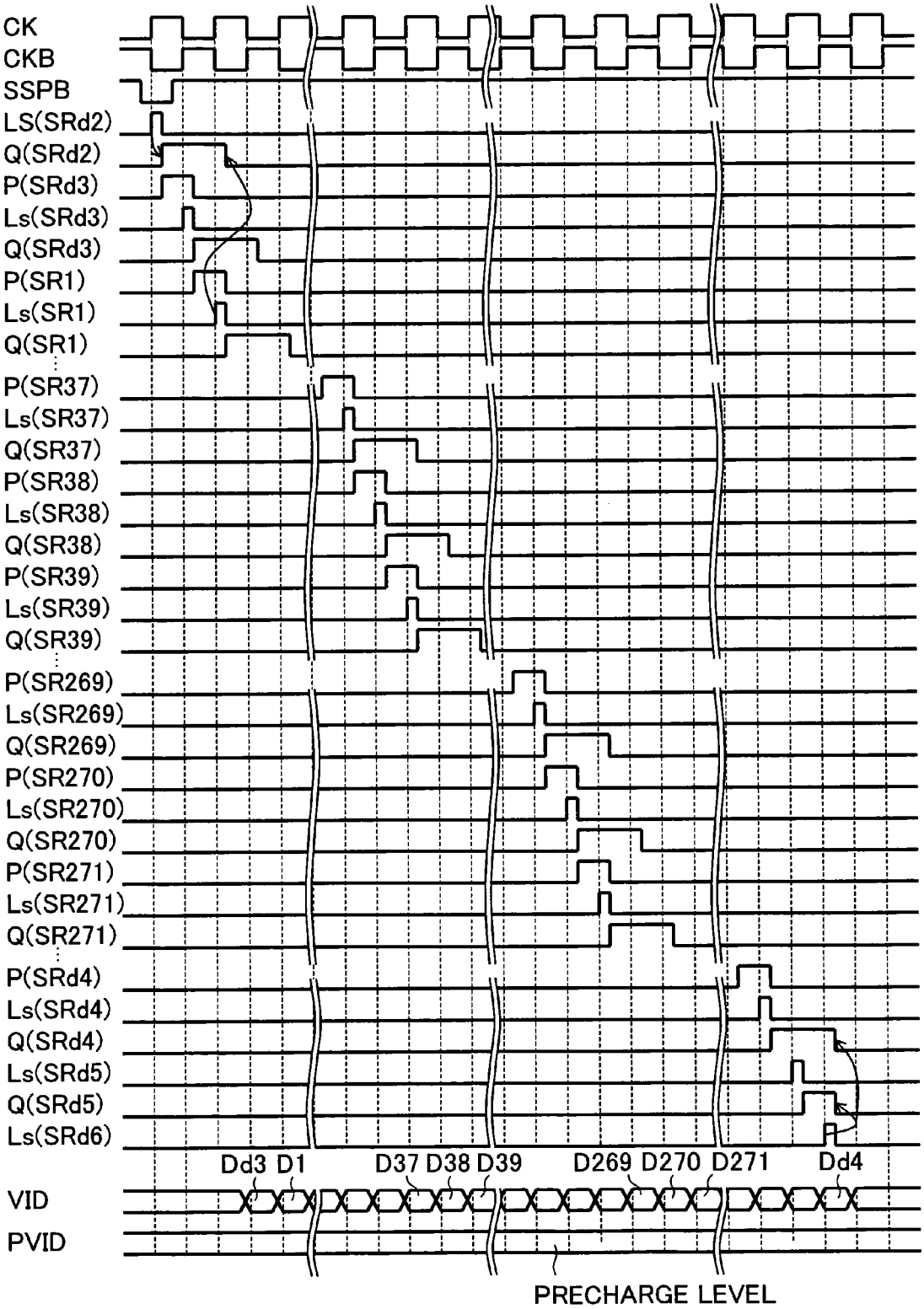

FIG. 16 is a timing diagram showing the operation of the shift register in the case of shifting from left to right in wide display (if ASPE is "H" and LR is "H", then WL is "H").

If SSPB becomes "L (active)", the output of the switch 32 of the NOR 36 (input EN of the level shifter 35) of the shift register circuit SRd2 becomes "H (active)". Thus, CKB shifted in level is tapped off from the (even-numbered) level shifter 35 of the shift register circuit SRd2. If CKB becomes "L", the output of the level shifter 35 becomes "L", and the output of the output end Ls of the shift register circuit SRd2 becomes "H (active)".

The output "L" of the level shifter 35 of SRd2 is fed into the input SB of the SR-FF of this SRd2. Thus, lagging behind the event that the output end Ls of SRd2 becomes "H (active)", the output (output end Q) of SRd2 becomes "H (active)" (output end QB is "L (active)"). If Q of SRd2 becomes "H", the output of the NOR 36 of SRd2 becomes "L", the output of the level shifter 35 becomes "H", and Ls of SRd2 becomes "L".

QB of SRd2 is connected to QB1 of SRd3. Therefore, if becomes "L", the output of the switch 32 of SRd3 becomes "L", and the output end P (output of the NOR 36) of the shift register circuit SRd3 becomes "H".

If the output of the NOR 36 of SRd3 becomes "H", CK shifted in level is tapped off from the (odd-numbered) level shifter 35 of SRd3. If CK becomes "L", the output of the level shifter 35 becomes "L", and the output end Ls of the shift register circuit SRd3 becomes "H (active)".

The output "L" of the level shifter 35 of SRd3 is fed into the input SB of the SR-FF of this SRd3. Thus, lagging behind the event that the output end Ls of SRd3 becomes "H (active)", the output Q of SRd3 becomes "H (active)", and the output of the NOR 36 of SRd3 (P of SRd3) becomes "L".

Around the time when this P of SRd3 becomes "L", the precharge signal (electric potential) from PVID is sampled at SMd3 and written onto the output Sd3 corresponding to SRd3.

If Ls of the shift register circuit SR1 becomes "H", "H" is fed into the reset R of the SR-FF of SRd2 via the switch 31 of SRd2, because Ls of SR1 is connected to Rrr of SRd2. Specifically, lagging behind the event of "H (active)" of Ls of SR1, the output Q of SRd2 becomes "L (inactive)".

Thereafter, if Ls of the shift register circuit SR2 becomes "H", "H" is fed into the reset R of the SR-FF of SRd3 via the switch 31 of SRd3, because Ls of SR2 is connected to Rrr of the shift register circuit SRd3. Specifically, lagging behind "H (active)" of Ls of SR2, the output Q of SRd3 becomes "L (inactive)". Around the time when Q of SRd3 becomes "L", the video data Dd3 from VID is sampled at SMd3 and written onto the output Sd3 corresponding to SRd3.

The foregoing shifting is repeated so that the shifting from the shift register circuit SRd2 to the shift register circuit SRd6 are carried out.

Figure 17:
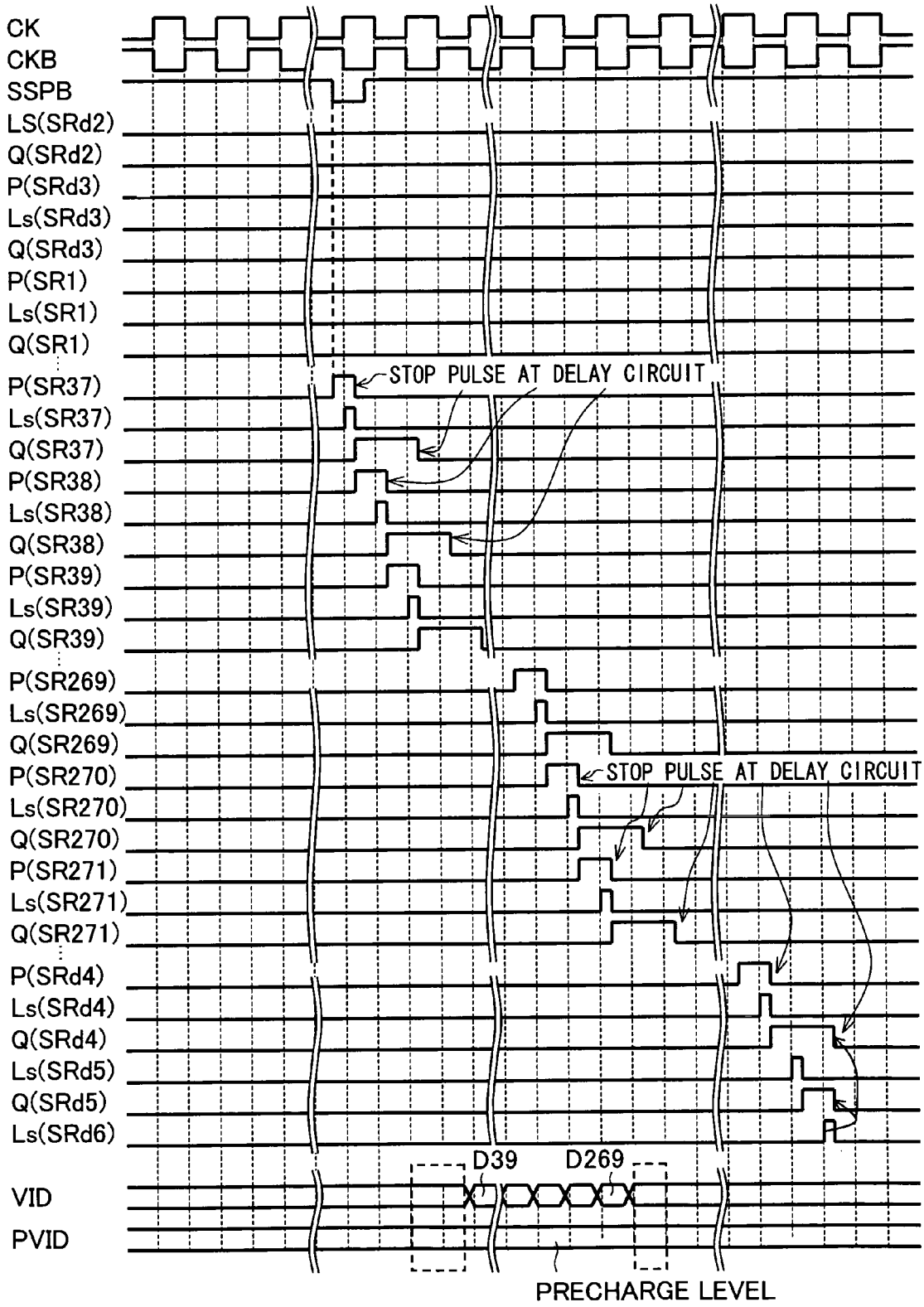

FIG. 17 is a timing diagram showing operation of the shift register in the case of shifting from left to right in partial-screen display (if ASPE is "L" and LR is "H", then NL is "H").

When SSPB is fed into the shift register circuit SR37, the shifting starts. Around the time when P of SR39 becomes "L", the precharge signal (electric potential) from PVID is sampled at SM39 and written onto the output S39 corresponding to SR39. Thereafter, around the time when Q of SR39 becomes "L", the video data D39 from VID is sampled at SM39 and written onto the output S39 corresponding to SR39. In SR37, SR38, SR270, and the stages subsequent to SR270, "H (active)" signals of P and Q are made "L (inactive)" at the delay circuits DL. By the foregoing way, the shifting from the shift register circuit SR37 to the shift register circuit SRd6 is carried out.

Figure 3:
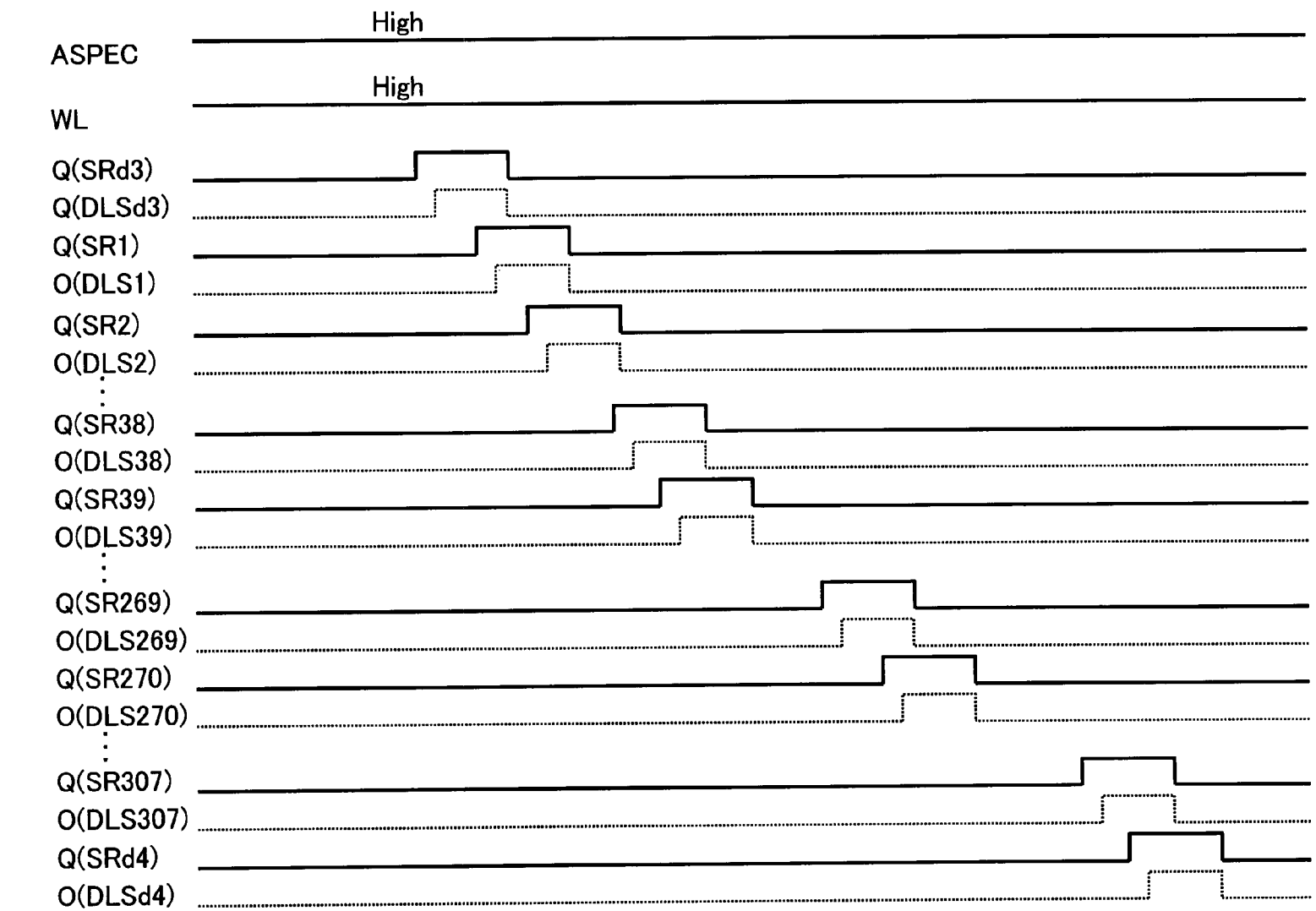

FIG. 3 shows a relationship between the outputs Q of the shift register circuits (SRd3 to SRd4) and the outputs O of their corresponding delay circuits (DLSd3 to DLSd4) in the case of shifting from left to right in wide display (if ASPE is "H" and LR is "H", then WL is "H"). As shown in this figure, as the outputs of the respective shift register circuits from SRd3 to SRd4 become active sequentially, the outputs of the respective delay circuits from DLd3 to DL4, also become active sequentially, lagging behind the shift register circuits.

Figure 4:
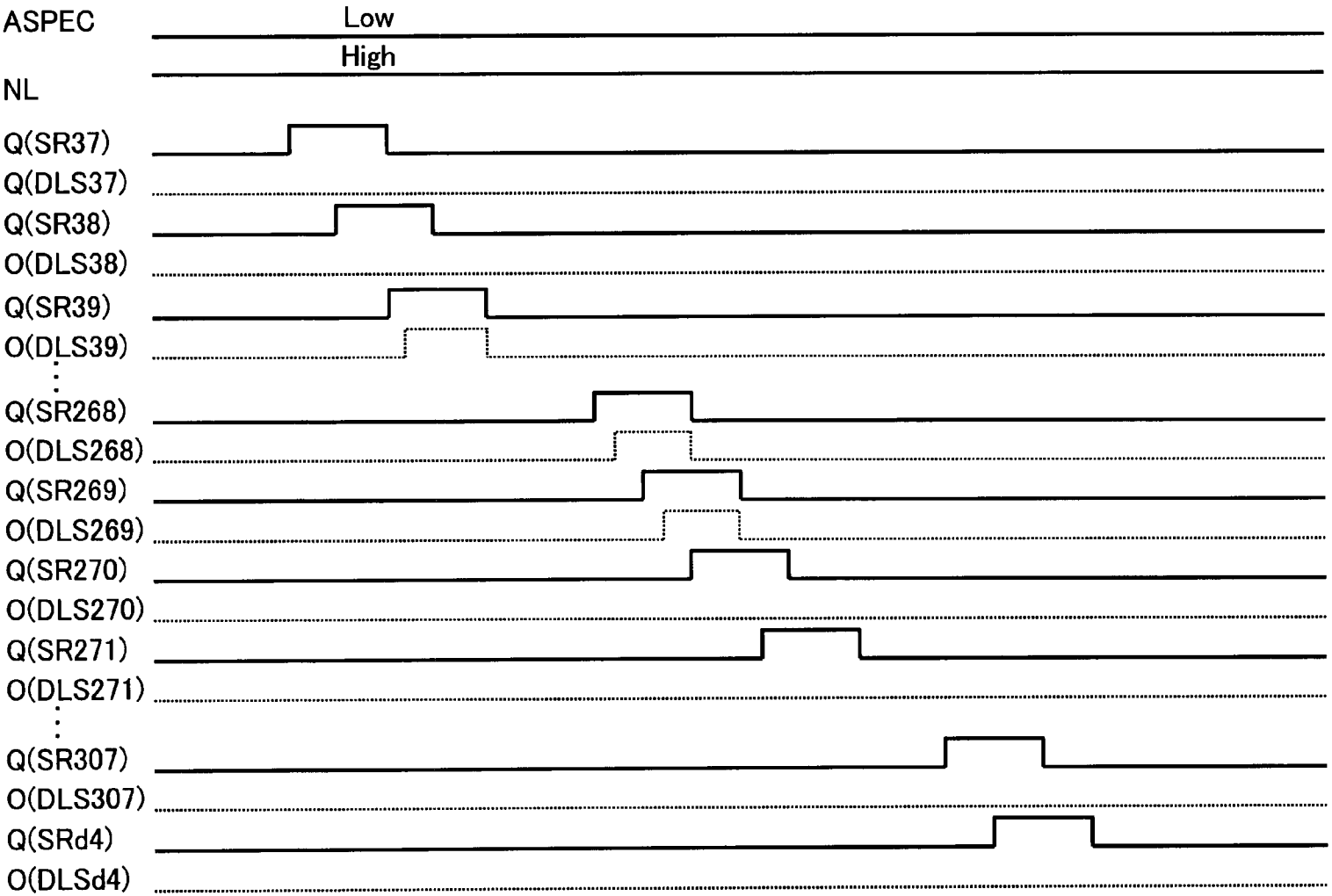

FIG. 4 shows a relationship between the outputs Q of the shift register circuits (SR37 to SRd4) and the output O of their corresponding delay circuits (DLS37 to DLSd4) in the case of shifting from left to right in partial-screen display (if ASPE is "L" and LR is "H", then NL is "H"). As shown in this figure, while the outputs of the shift register circuits from SR37 to SRd4 all become active sequentially, the outputs of the delay circuits DLS37, DLS38, and DLS270 to DLSd4, all of which correspond to the wide-display sections 5*a* and 5*b*, do not become active. Specifically, this tells that pulses tapped off from the shift register circuits SR37, SR38, and SR270 to DLSd4 are interrupted by the delay circuits DLS37, DLS38, and DLS270 to DLSd4. As a result, the data from the video data line L3 is not transmitted to the wide-display sections 5*a* and 5*b*, and the wide-display sections 5*a* and 5*b* do not show a display. At this time, the mask data MVID is transmitted from the line L4 (see FIG. 5) to the wide-display sections 5*a* and 5*b* via the mask switch circuits (BLd3 to BL38, BL270 to BLd4).

Embodiment 2

Figure 18:
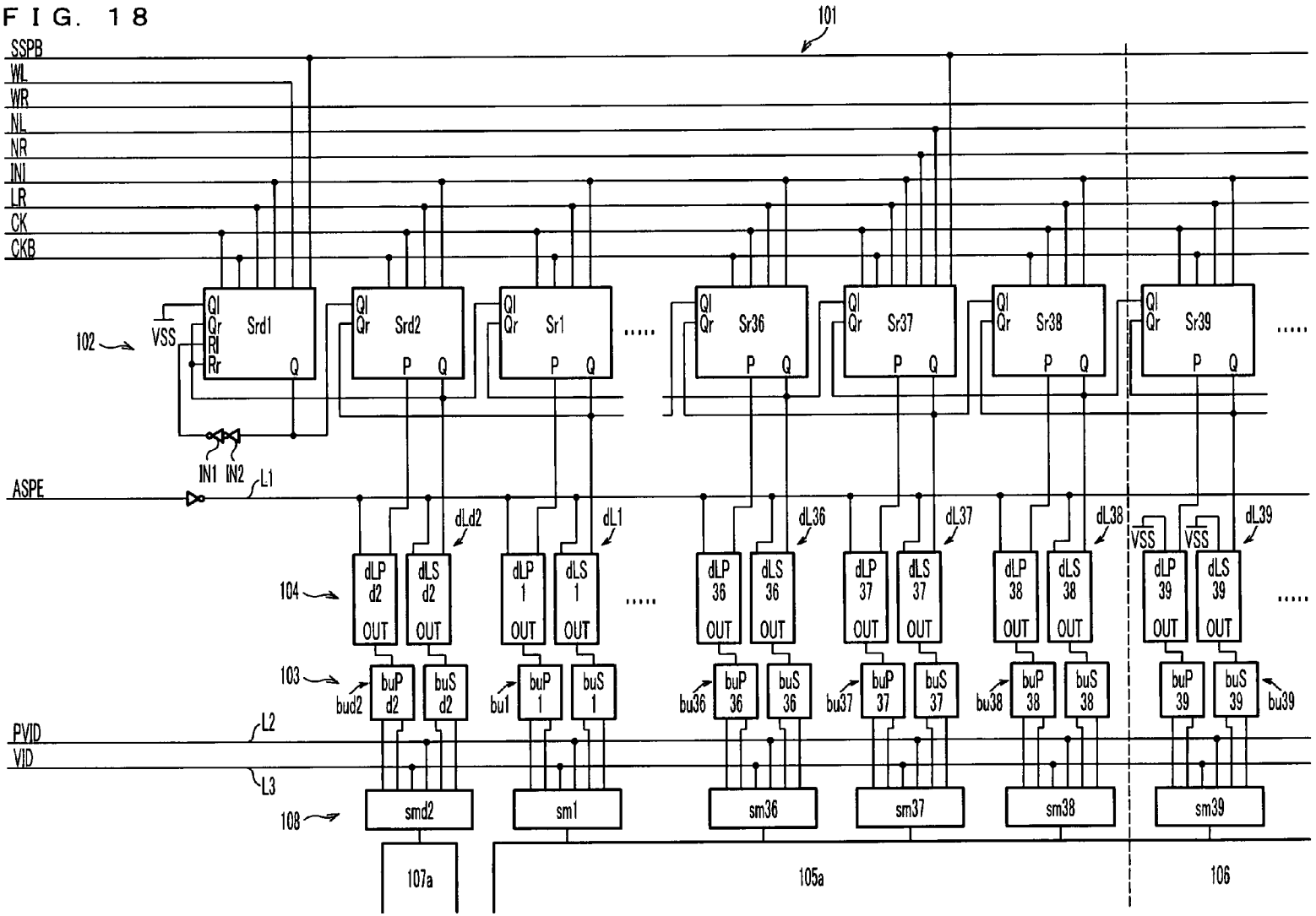
Figure 19:
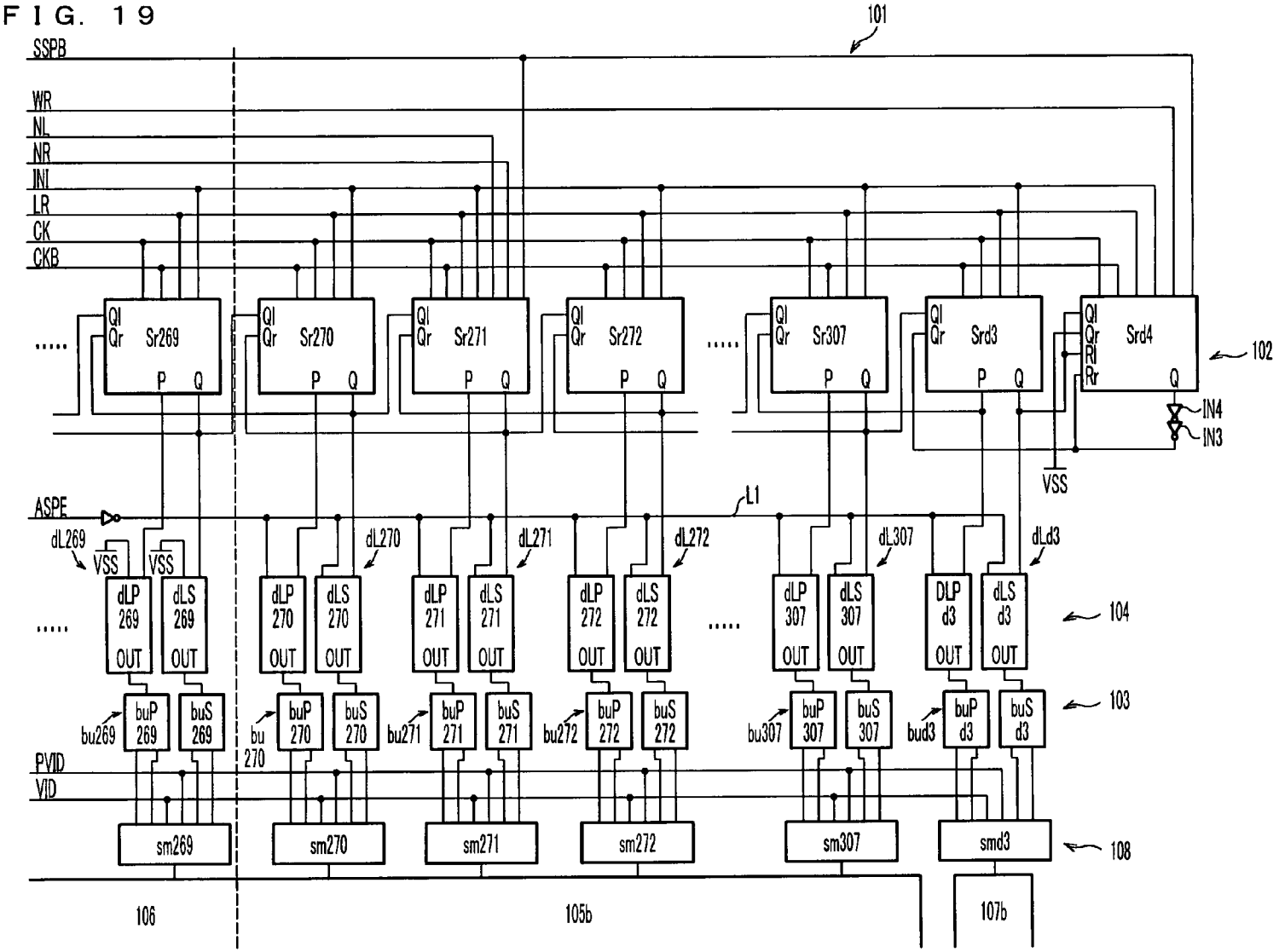
Figure 20:
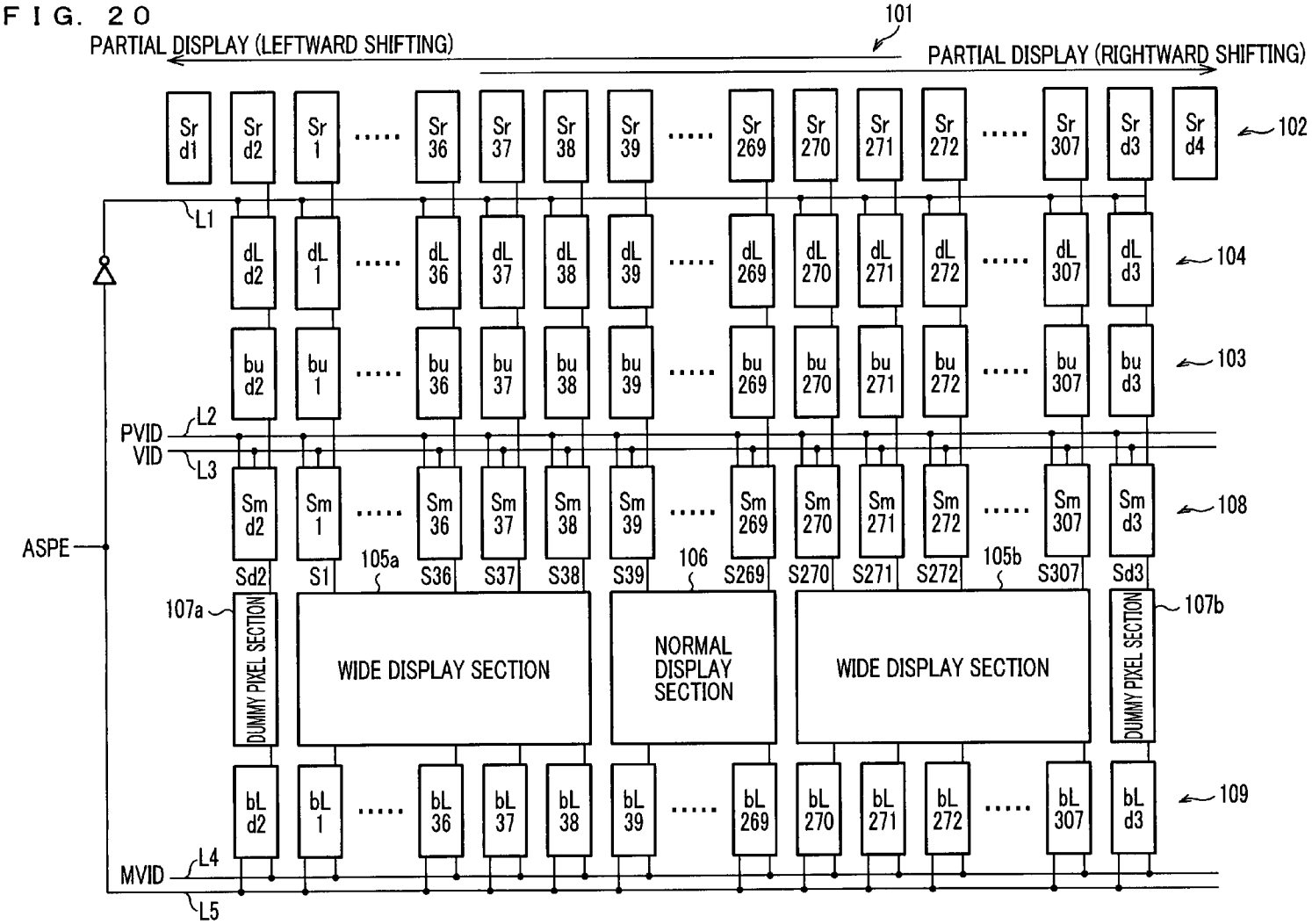

The following describes another embodiment of the present invention. FIGS. 18 to 20 are schematic diagrams each showing a configuration of a display device in accordance with Embodiment 2. As shown in this figure, a display device 101 includes a source driver and a display section. The source driver includes a shift register 102, a delay circuit section 104, a buffer circuit section 103, a sampling circuit section 108, and a mask switch circuit section 109. The display section includes an output line s (sd3, s1 to s307, and sd4), a normal-display section 106, wide-display sections (mask section) 105*a* and 105*b*, and dummy pixel sections 107*a* and 107*b*. Illustration of how the stages of the shift register 102 are connected is omitted in FIG. 20.

The shift register 102 includes a plurality of shift-register stages (dummy stages Srd1 to Srd2, stages Sri to Sr307, and dummy stages Srd3 to Srd4 (in the order as provided, starting at an end)). The delay circuit section 104 includes a plurality of delay circuits (dLd2, dL1 to dL307, and dLd3 (in the order as provided, starting at an end)). The buffer circuit section 103 includes a plurality of buffer circuits (bud2, bu1 to bu307, and bud3 (in the order as provided, starting at an end)). The sampling circuit section 108 includes a plurality of sampling circuits (Smd2, Sm1 to Sm307, and Smd3 (in the order as provided, starting at an end)). The mask switch circuit section 109 includes a plurality of mask switch circuits (bLd2, bL1 to bL307, bLd3 (in the order as provided, starting at an end)).

A shift-register stage Sri, a delay circuit dLi, a buffer circuit bui, and a sampling circuit Smi are connected in this order, and the sampling circuit Smi is connected to an output line si (note that i is an integer in the range of 1 to 307). In this manner, a shift-register stage Srd2, a delay circuit dLd2, a buffer circuit bud2, a sampling circuit Smd2, and an output line sd2 are connected. A shift-register stage Srd3, a delay circuit dLd3, a buffer circuit bud3, a sampling circuit Smd3, and an output line sd3 are connected in the same manner.

The sampling circuit Smd2 is connected to the dummy pixel section 107*a* via the output line sd2. The sampling circuits Sm1 to Sm38 are connected to the wide-display section 105*a* via the output lines s1 to s38, respectively. The sampling circuits Sm39 to Sm269 are connected to the normal-display section 106 via the output lines s39 to s269, respectively. The sampling circuits Sm270 to 307 are connected to the wide-display section 105*b* via the output lines s270 to 307. The sampling circuit Smd3 is connected to the dummy pixel section 107*b* via the output line sd3. The mask switch circuit bLd2 is connected to the dummy pixel section 107*a*. The mask switch circuits bL1 to 38 are connected to the wide-display section 105*a*. The mask switch circuits bL39 to 269 are connected to the normal-display section 106. The mask switch circuits bL270 to 307 are connected to the wide-display section 105*b*. The mask switch circuit bLd3 is connected to the dummy pixel section 107*b*.

The shift register 102 is configured for one-fold pulses. With the shift register 2, shifting in two direction is possible. Further, the shift register 2 performs shifting operation to divide the shift register by two in partial-screen display (only the normal-display section 106 shows a display). Specifically, in partial-screen display, if the shifting is rightward (see the arrows in the figure), the shift register circuits Sr37 to Srd4 operate. If the shifting is leftward (see the arrows in the figure), the shift register circuits Sr271 to Srd1 operate. On the other hand, in wide display (the wide-display section 105 as well as the normal-display section 106 show a display), the shift register circuits Srd1 to Srd4 operate if the shifting is rightward, and the shift register circuits Srd4 to Srd1 operate if the shifting is leftward.

The following describes a configuration and operation of the respective shift register circuits.

FIG. 21 shows a configuration of the shift register circuits Srd2, Sr1 to Sr36, Sr38 to Sr270, Sr272 to 307, and Srd3 (the shift register circuits will be referred to as a shift register circuit x hereinafter). As shown in this figure, the shift register circuit x includes a switch 30, a switch 31, a switch 32, a level shifter 35, a NAND 33, a set-reset flip-flop (the set-reset flip-flop will be referred to as an SR-FF hereinafter) 37, and an inverter 38. The shift register circuit x has six input ends (CK, CKB, LR, INI, Qr, Q1) and two output ends (P, Q). The switches (30 to 32) each have an input-a, an input-b, an input-c, an input-cb, and an output-o. The level shifter is connected to the input ends CK and CKB, and has an input EN and an output-ob. The SR-FF is connected to an input end INI, and has an input SB (set bar) and a reset R. An output of the SR-FF is connected to the output end Q (of the shift register circuit x). The NAND 33 has two inputs. The inverter 38 amplifies a signal of positive logic to produce a signal of negative logic as an output.

The input-a of the switch 30 is connected to the input end Q1. The input-b of the switch 30 is connected to the input end Qr. The input-c of the switch 30 is connected to the input end LR. The input-cb of the switch 30 is connected to an output of the inverter 38. An input of the inverter 38 is connected to LR. The input-a of the switch 31 is connected to Qr. The input-b of the switch 31 is connected to Q1. The input-c of the switch 31 is connected to the input end LR. The input-cb of the switch 31 is connected to the output of the inverter 38. The input-a of the switch 32 is connected to the output-o of the switch 30. The input-b of the switch 32 is connected to VSS. The input-c of the switch 32 is connected to VDD. The input-cb of the switch 32 is connected to VSS. The output-o of the switch 32 is connected to the input end EN of the level shifter 35. The output-ob of the level shifter 35 is connected to an input of the NAND 33. The other one of the inputs of the NAND 33 is connected to VDD. An output of the NAND 33 is connected to the input SB of the SR-FF 37. The reset R of the SR-FF 37 is connected to the output-o of the switch 31. The output of the SR-FF is connected to the output end Q of the shift register circuit x. P of the shift register circuit x is connected to the output-o of the switch 32.

Figure 22:
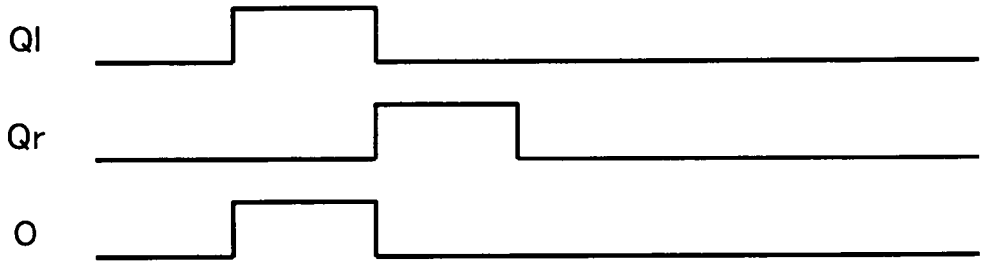
Figure 22:
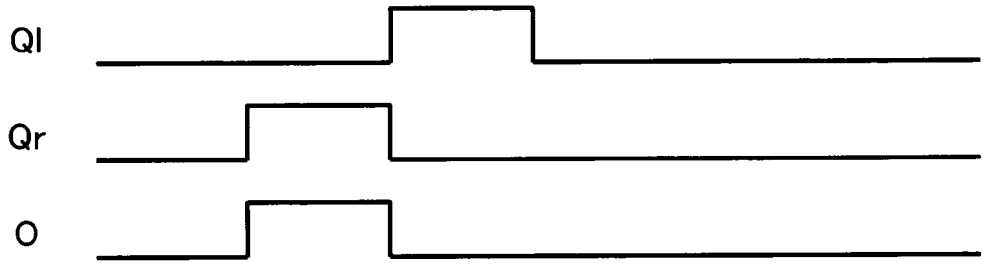
Figure 23:
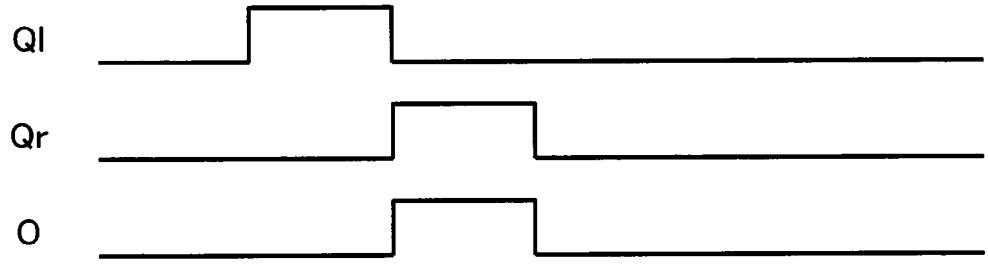
Figure 23:
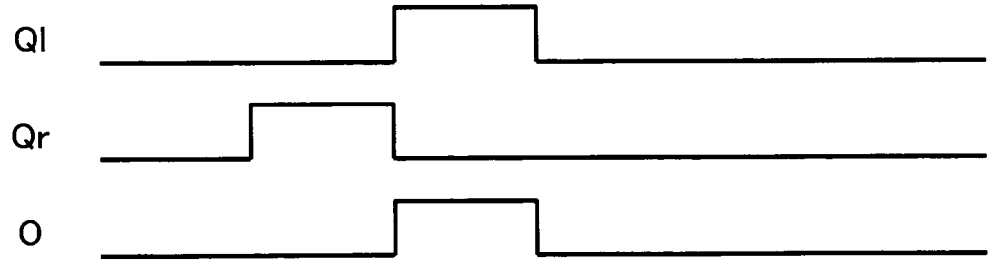

The switch 30 of the shift register circuit x operates as shown in FIG. 22(*a*) if the input end LR is "H", and operates as shown in FIG. 22(*b*) if the input end LR is "L". Further, the switch 31 operates as shown in FIG. 23(*a*) if the input end LR is "H", and operates as shown in FIG. 23(*b*) if the input end LR is "L".

FIG. 24 shows a configuration of the shift register circuits Sr37 and Sr271 (the shift register circuits will be referred to as a shift register circuit y hereinafter). As shown in this figure, the shift register circuit y is constituted by the same components as those of the shift register circuit x. Specifically, the shift register circuit y is constituted by the switch 30, the switch 31, the switch 32, the level shifter 35, the NAND 33, and the set-reset flip-flop (the set-reset flip-flop will be referred to as an SR-FF hereinafter) 37. The shift register circuit y has nine input ends (NL, NR, CK, CKB, LR, INI, Q1, Qr, SSP) and two output ends (P, Q). The switches (30 to 32) each have the input-a, the input-b, the input-c, the input-cb, and the output-o. The level shifter is connected to the input ends CK and CKB, and has the input EN and the output-ob. The SR-FF 37 is connected to the input end INI, and has the input SB (set bar) and the reset R. The output of the SR-FF 37 is connected the output end Q (of the shift register circuit y).

How the switch 32 is connected and how the NAND 33 is connected differ from those in the shift register circuit x, but the rest are same. Specifically, the input-b of the switch 32 is connected to SSP. In Sr37, NR is fed into an inverter. An output of the inverter is connected to one of the inputs of the NAND 33. The input-cb of the switch 32 is connected to the input end NL. The input end NL is connected to the input-c of the switch 32 via an inverter. Further, in Sr271, NL is fed into an inverter. An output of the inverter is connected to the one of the inputs of the NAND 33. The input-cb of the switch 32 is connected to NR. The input end NR is connected to the input-c of the switch 32 via an inverter.

Figure 25:
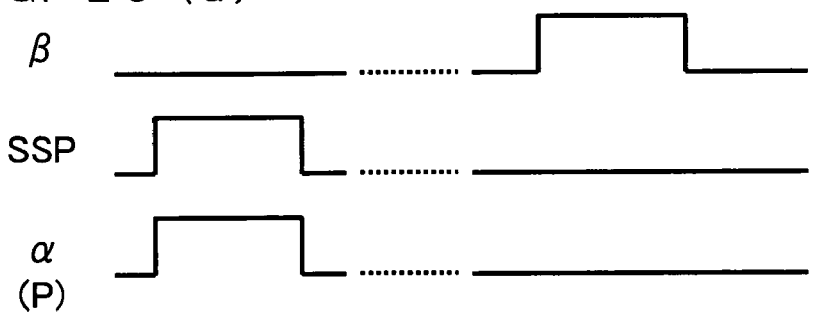
Figure 25:
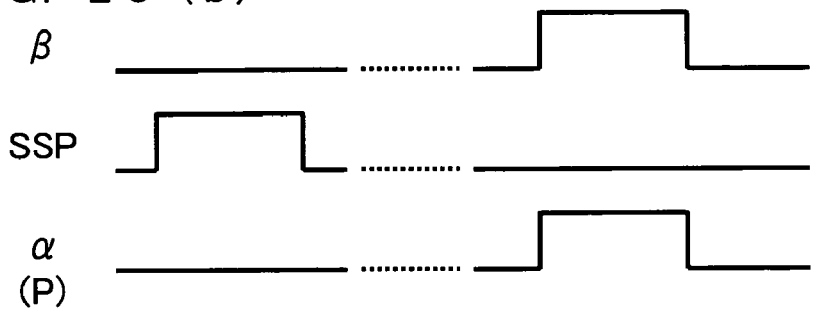

The switch 32 of the shift register circuit y operates as follows. With regard to Sr37, if NL is "H" and NR is "L" (ASPE is "L" and LR is "H"), Sr37 operates as shown in FIG. 25(*a*). If NL is "L" and NR is "H" (ASPE is "L" and LR is "L"), Sr37 operates as shown in FIG. 25(*b*). With regard to Sr271, if NL is "L" and NR is "H" (ASPE is "L" and LR is "L"), Sr271 operates as shown in FIG. 25(*a*). If NL is "H" and NR is "L" (ASPE is "L" and LR is "H"), Sr271 operates as shown in FIG. 25(*b*).

Figure 26:
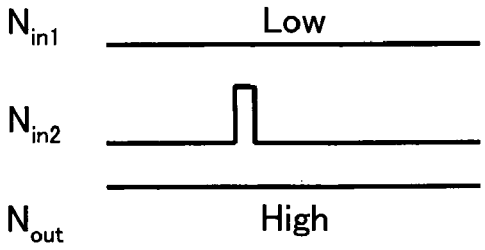
Figure 26:
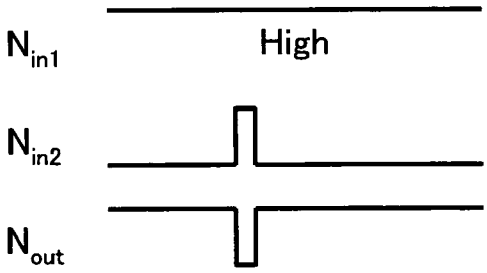

The NAND 33 operates as follows (two inputs of the NAND 33 are referred to as Nin1 and Nin2, and an output of the NAND 33 is referred to as Nout). Specifically, with regard to Sr37, if NL is "H" and NR is "L" (Nin1 is "H"), Sr37 operates as shown in FIG. 26(*b*). If NL is "L" and NR is "H" (Nin1 is "L"), Sr37 operates as shown in FIG. 26(*a*). With regard to Sr271, if NL is "L" and NR is "H" (Nin1, is "H"), Sr271 operates as shown in FIG. 26(*b*). If NL is "H" and NR is "L" (Nin1 is "L"), Sr271 operates as shown in FIG. 26(*a*).

FIG. 27 shows a configuration of the shift register circuits Srd1 and Srd4 (the shift register circuits will be referred to as a shift register circuit z hereinafter). As show in this figure, the shift register circuit z is constituted by the same components as those of the shift register circuit x. Specifically, the shift register circuit z includes the switch 30, the switch 31, the switch 32, the level shifter 35, the NAND 33, and the set-reset flip-flop (the set-reset flip-flop will be referred to as an SR-FF hereinafter) 37. The shift register circuit z has 10 input ends (WL/WR, CK, CKB, LR, INI, Q1, Qr, SSP, Rr, R1) and one output end (Q). The switches (30 to 32) each have the input-a, the input-b, the input-c, the input-cb, and the output-o. The level shifter is connected to the input ends CK and CKB, and has the input EN and the output-ob. The SR-FF 37 is connected to the input end INI, and has the input SB (set bar) and the reset R. The output of the SR-FF 37 is connected to the output end Q (of the shift register circuit y).

How the switch 32 is connected differs from that in the shift register circuit x, but the rest are same. The input-a of the switch 31 is connected to Rr, and the input-b of the switch 31 is connected to R1. The input-b of the switch 32 is connected to SSP. In Srd1, the input end WL is connected to the input-c of the switch 32, and the input end WL is also connected to the input-c of the switch 32 via an inverter. In Srd4, the input end WR is connected to the input-c of the switch 32, and the input end WR is also connected to the input-c of the switch 32 via an inverter.

Figure 28:
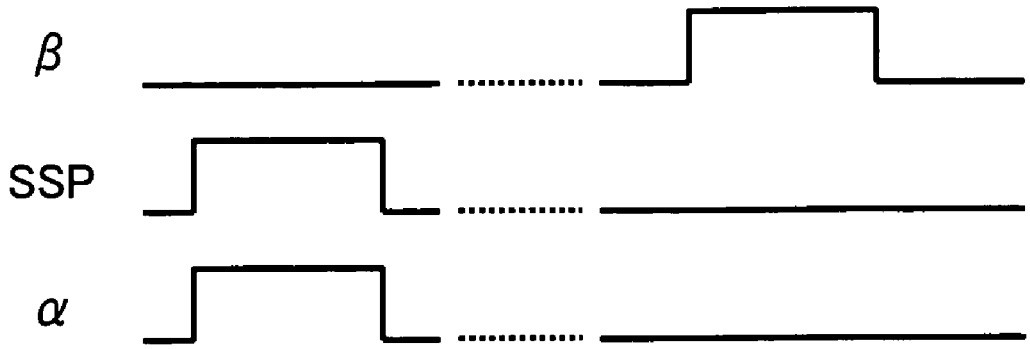
Figure 28:
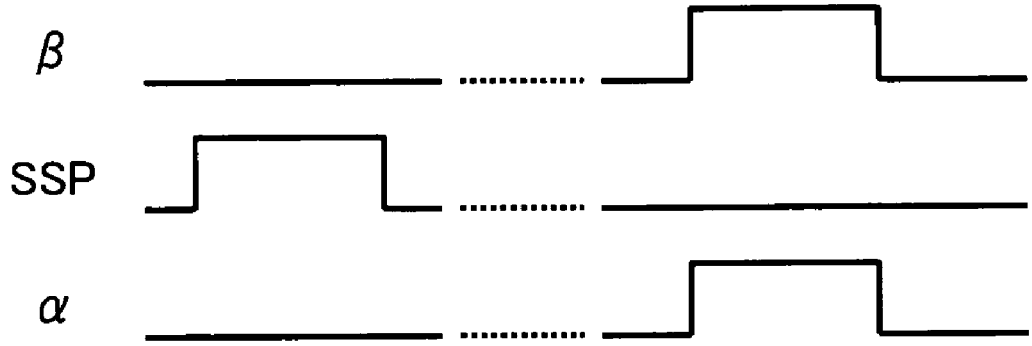

The switch 32 of the shift register circuit z operates as follows. Specifically, with regard to Srd1, if WL is "H" and WR is "L" (ASPE is "H" and LR is "H"), Srd1 operates as shown in FIG. 28(*a*). If WL is "L" and WR is "H" (ASPE is "H" and LR is "L"), Srd1 operates as shown in FIG. 28(*b*). With regard to Srd4, if WL is "L" and WR is "H" (ASPE is "H" and LR is "L"), Srd4 operates as shown in FIG. 28(*a*). If WL is "H" and WR is "L" (ASPE is "H" and LR is "H"), Srd4 operates as shown in FIG. 28(*b*).

The shift register circuits in the shift register 102 are connected as follows.

The following discusses the shift register circuits Srn (n is in the range of 1 to 307) shown in FIGS. 18 and 19. Q1 is connected to Q of Srn−1 (shift register circuit on the left). Qr is connected to Q of Srn+1 (shift register circuit on the right). P is connected to the precharge delay circuit dLPn. Q is connected to the data delay circuit dLSn. The same applies to the shift register circuits Srd2 and Srd3.

With regard to Srd1, Q1 is connected to VSS, Qr is connected to Rr of Srd1 and to Q of Srd2, Rr is connected to Q of SRd2, R1 is connected to an output of an inverter IN1, Q is connected to both Q1 of Srd2 and an input of an inverter 2 connected serially to the inverter IN1.

With regard to Srd4, Qr is connected to Vss, Q1 is connected to both R1 of Srd4 and Q of Srd3, R1 is connected to Q of SRd3, Rr is connected to both an output of an inverter IN3 and Qr of Srd3, and Q is connected to an input of an inverter 4 connected serially to the inverter IN3.

The following describes the delay circuit section 104, the buffer circuit section 103, and the sampling circuit section 108. Each delay circuit dL (dLd2, dL1 to dL307, and dLd3 (in the order as provided, starting at an end)) includes a precharge delay circuit dLP and a data delay circuit dLS. Specifically, a delay circuit dLi (i is an integer in the range of 1 to 307) includes a precharge delay circuit dLPi and a data delay circuit dLSi. A delay circuit dLd2 includes a precharge delay circuit dLPd2 and a data delay circuit dLSd2.

Further, each buffer circuit bu includes a precharge buffer circuit buP and a data buffer circuit buS. Specifically, a buffer circuit bui (i is an integer in the range of 1 to 307) S includes a precharge buffer circuit buPi and a data buffer circuit buSi. A buffer circuit bud2 includes a precharge buffer circuit buPd2 and a data buffer circuit buSd2.

The precharge delay circuits (dLP1 to dLP38, dLP270 to dLP307) corresponding to the wide-display sections 105*a* and 105*b* and the data delay circuits (dLS1 to dLS38, dLS270 to dLS307) corresponding to the wide-display sections 105*a* and 105*b* are connected to the display-mode line L1. Note that the precharge delay circuits (dLP39 to dLP269) corresponding to the normal-display section 106 and the data delay circuits (dLS39 to dLS269) corresponding to the normal-display section 106 are not connected to the display-mode line L1. An inversion signal of the display mode signal ASPE is transmitted to the line L1.

The precharge delay circuit dLP is connected to the sampling circuit Sm via the precharge buffer circuit buP. The data delay circuit dLS is connected to the sampling circuit Sm via the data buffer circuit buS. Specifically, a precharge delay circuit dLPi (i is an integer in the range of 1 to 307) is connected to a sampling circuit Smi via a precharge buffer circuit buPi. A data delay circuit dLSi (i is an integer in the range of 1 to 307) is connected to a sampling circuit Smi via a data buffer circuit buSi. A precharge delay circuit dLPd2 is connected to a sampling circuit Smd2 via a precharge buffer circuit buPd2. A data delay circuit dLSd2 is connected to a sampling circuit Smd2 via a data buffer circuit buSd2. The same applies to a precharge delay circuit dLPd3 and a data delay circuit dLSd3.

The sampling circuits Sm (Smd2, Sm1 to Sm307, and Smd3 (in the order as provided, starting at an end)) are connected to the output lines (sd2, s1 to s307, and sd3). Specifically, a sampling circuit Smi (i is an integer in the range of 1 to 307) is connected to an output line si. The same applies to the sampling circuits Smd2 and Smd3. The sampling circuits Smd2 and Smd3 are connected to the output lines sd2 and sd3, respectively. The respective sampling circuits Sm are connected to the precharge line L2 and the video line L3. The precharge signal (electric potential) PVID is transmitted to the precharge line L2, and the video signal (electric potential) VID is transmitted to the video line L3. The respective sampling circuits Sm connect the output line s and the precharge line L2 in response to a signal from the precharge buffer circuit buP, and connect the output line and the video line L3 in response to a signal from the data buffer circuit buS. With the foregoing arrangement, precharging and writing on video data are performed on the respective output lines (sd2, s1 to s307, sd3).

The data delay circuit dLS and the precharge delay circuit dLP are configured and operate in the same manner as the data delay circuit DLS and the precharge delay circuit DLP of Embodiment 1.

The following describes the mask switch circuits shown in FIG. 20. The mask switch circuits (bLd2, bL1 to 307, and bLd3) are analog switches. The mask switch circuits (bLd2, bL1 to bL38, bL270 to bL307, and bLd3) corresponding to the wide-display section 105 and the dummy pixel sections 107*a* and 107*b* are connected to the mask line L4 and the display-mode line L5. The mask switch circuits (bL39 to 269) corresponding to the normal-display section 106 are connected only to the mask line L4. The line L4 is fed with mask signal data MVID. The line L5 is fed with a display mode signal ASPE. During wide display (ASPE is "H"), the mask switch circuits bL are all closed. On the other hand, in partial-screen display (ASPE is "L"), the mask switch circuits connected to the wide-display sections 105*a* and 105*b* and to the dummy pixel sections 107*a* and 107*b* become ON, and the wide-display sections 105*a* and 105*b* and the dummy pixel sections 107*a* and 107*b* are fed with the mask signal data MVID via the mask line L4. The mask switch circuit connected to the normal-display section 106 is connected so that the loads are equalized, although the mask switch circuit stays in an OFF state regardless of whether the display is the wide display or the partial-screen display.

The following describes operation of the shift register 102.

Figure 29:
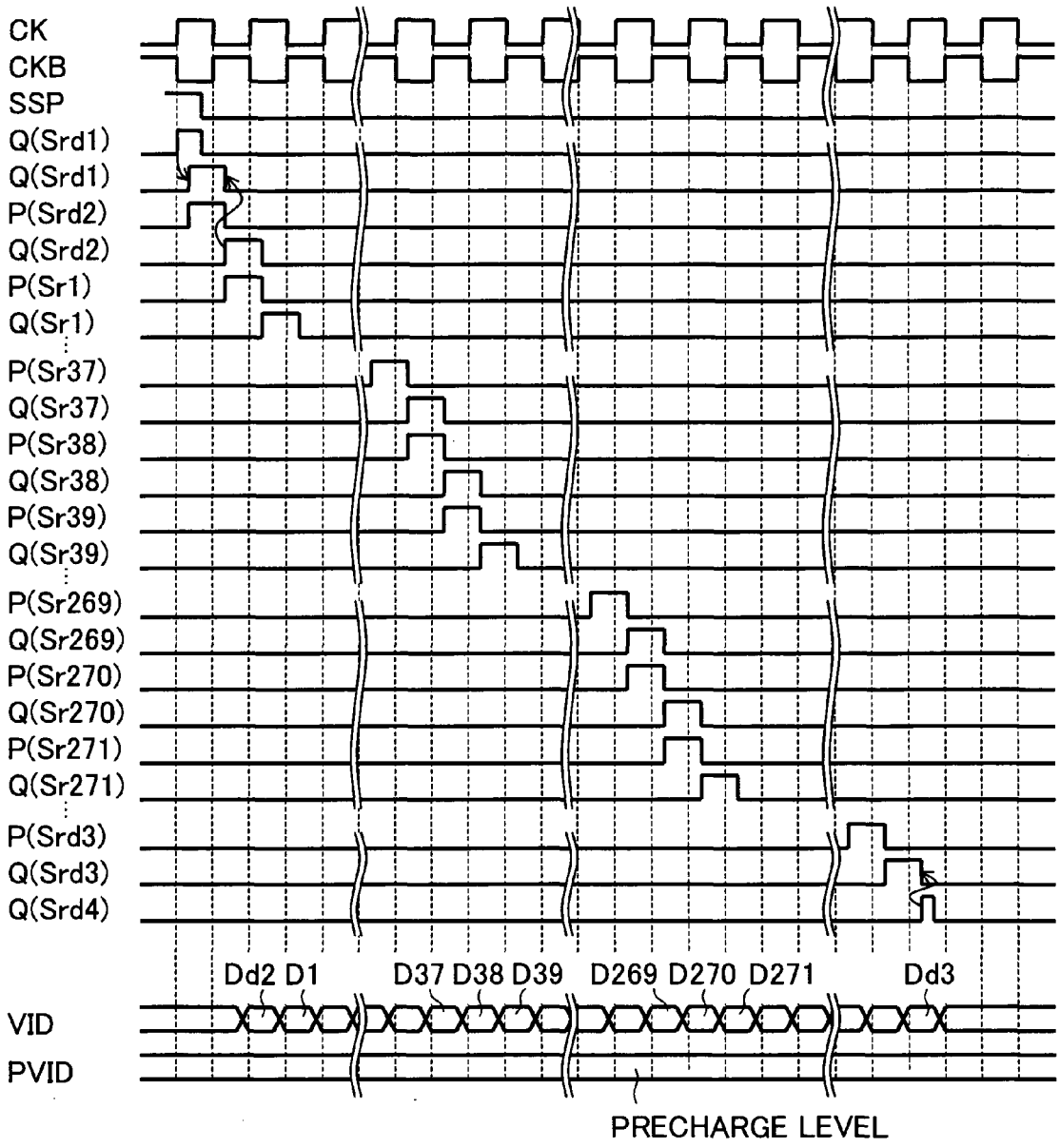

FIG. 29 is a timing diagram showing the operation of the shift register 102 in the case of shifting from left to right in wide display (if ASPE is "H" and LR is "H", then WL is "H").

Figure 30:
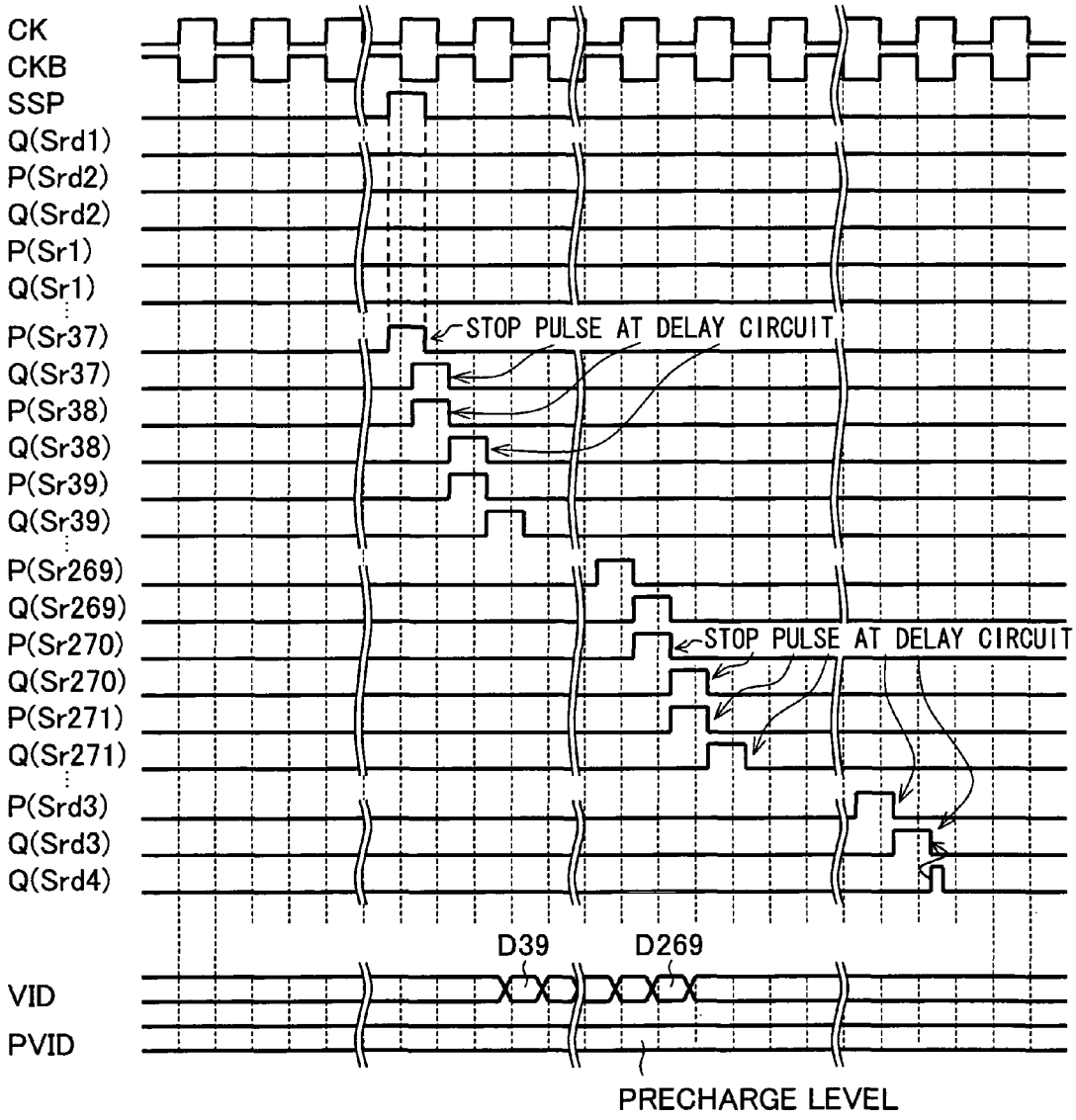

FIG. 30 is a timing diagram showing the operation of the shift register in the case of shifting from left to right in partial-screen display (if ASPE is "L" and LR is "H", then NL is "H"). When SSPB is fed into the shift register circuit Sr37, the shifting starts. Around the time when P of Sr39 becomes "L", the precharge signal (electric potential) from PVID is sampled at Sm39 and written onto the output sd3 corresponding to Sr39. Thereafter, around the time when Q of Sr39 becomes "L", the video data D39 is sampled at Sm39 and written onto the output s39 corresponding to Sr39. In Sr37, Sr38, Sr270, and the subsequent shift register circuits, "H (active)" signals of P and Q are made "L (inactive)" at the delay circuits dL. By the foregoing way, the shifting from the shift register circuit Sr37 to the shift register circuit Srd4 is carried out.

As the foregoing describes, in the present embodiment, to show a partial-screen display, the shift register 2 is caused to operate up to an end section to tap off a signal (generate a pulse), and signals from the stages corresponding to the wide-display section are interrupted at the delay circuit DL, which is at the lower stage of the shift register 2, by use of the partial-screen display signal (ASPE). Accordingly, it is not necessary even in partial-screen display to stop the shift register 2 between a first stage and a last stage of the shift register 2. Thus, it is not necessary to provide a special stage (stage of different configuration) in an in-between section of the shift register 2 to stop the shifting. This prevents signal defects such as phase shifts resulting from pulse delays that occur as a result of inclusion of a stage of different configuration, so that high-quality display becomes possible. Further, a gate circuit that is necessary in the conventional configurations becomes unnecessary, which makes it possible to reduce an area of the circuits.

Further, in the present embodiment, the shift register 2 is not stopped at an in-between section of the shift register 2 even if a partial-screen display. Thus, even if the set-reset flip-flop is employed, no stage of different configuration is provided in an in-between section of the shift register 2. Therefore, high-quality display becomes possible, compared with a case of source drivers in which a set-reset flip-flop is employed as the shift register.

Further, in the present embodiment, the shift register circuits SR are identical in configuration. This makes it possible to further prevent signal defects such as phase shifts. Further, in the present embodiment, the shift register is not stopped between the first stage and the last stage of the shift register in partial-screen display. This makes the shifting in two directions possible, and makes it possible to avoid inclusion of a stage of different configuration at an in-between section of the shift register. Thus, shifting in two directions and high-quality display are both realized.

Note that the level shifter 35 of the respective shift register circuits SR may be configured with the circuit shown in FIG. 33, for example. In place of the level shifter 35, it is possible to employ a switch circuit (gate) that includes input signals CK and CKB that are shifted in level to the operating voltage, a P-channel MOS transistor and an N-channel MOS transistor, which are coupled, and an inverter, as shown in FIG. 34(*a*). The switch circuit operates in the same manner as the level shifter, as shown in FIG. 34(*b*).

Accordingly, with the present configurations, it becomes possible to interrupt sampling pulses and precharge pulses of stages corresponding to the mask section (wide-display section), without increasing pulse delay. Conventionally, it has been necessary to feed video data corresponding to the mask section, both at the beginning and at the end of scanning. This becomes unnecessary by interrupting the pulses. Specifically, no special process needs to be carried out on the video signals at an external circuit that drives the panel. Further, a timing relationship of clocks needs to be changed neither in full (wide) display nor in partial-screen display.

Further, the foregoing Embodiments discuss a method in which the precharging is carried out sequentially prior to the sampling, but the present invention is not limited thereto. For example, the present concept is applicable to a method in which data lines are all precharged at once before the sampling in the display section starts (prior to a horizontal blanking period). Further, in the present embodiment, interruption of pulses is carried out at each delay circuit DL. Thus, the foregoing effects are produced without increasing the circuit size of the source driver.

The present invention is not limited to the description of the embodiments above, but may be altered by a skilled person within the scope of the claims. An embodiment based on a proper combination of technical means disclosed in different embodiments is encompassed in the technical scope of the present invention.

The following are descriptions of some of the reference numerals: 1 and 101 are display devices; 2 and 102 are shift registers; 3 and 103 are buffer circuit sections; 4 and 104 are delay circuit sections; 5 and 105 are wide-display sections (mask section); 6 and 106 are normal-display sections; 7 and 107 are dummy pixel sections; 8 and 108 are sampling circuit sections; 9 and 109 are mask switch circuit sections; 30 to 32 are switches; 33 is NAND; 35 is a level shifter; 36 is NOR; SR and Sr are shift register circuits; DL and dL are delay circuits; Bu and bu are buffer circuits; SM and Sm are sampling circuits; S and s are output lines; L1 is a display-mode line; L2 is a precharge line; and L3 is a video line.

INDUSTRIAL APPLICABILITY

A driving circuit (source driver) of a display device in accordance with the present invention is widely applicable to display devices such as display panels of mobile devices, TV, and monitors.

The invention claimed is:

1. A driving circuit of a display device, by which circuit a non-display area is created on a display section of the display device so that a partial-screen display becomes available, the driving circuit comprising:

a shift register; and a signal processing circuit connected to a stage of the shift register, the signal processing circuit configured to process a signal received from the stage of the shift register, the signal processing circuit including an interrupting circuit, the interrupting circuit having a delay section including an inverter for delaying the received signal by inverting the received signal, the interrupting circuit configured to delay the received signal using the delay section if the display device is in wide-screen mode, the interrupting circuit configured to interrupt the received signal if the display device is in partial-screen display mode.

2. The driving circuit of claim 1, wherein each stage of the shift register is configured to operate in the wide-screen mode and the partial-screen display mode.

3. The driving circuit of claim 1, wherein every stage of the shift register that corresponds to the display section is the same in configuration.

4. The driving circuit of claim 1, wherein the received signal is a data sampling pulse.

5. The driving circuit of claim 1, wherein the received signal is a precharge pulse.

6. The driving circuit of claim 1, wherein the interrupting circuit is configured to interrupt the received signal based on a state of a partial-display mode signal.

7. The driving circuit of claim 6, wherein the interrupting circuit is configured to delay the received signal the partial-display mode signal is in an off state.

8. The driving circuit of claim 6, wherein:

the interrupting circuit includes a first NOR circuit and a logic circuit that includes the delay section; and the logic circuit is configured to receive the partial-display mode signal and the received signal, and the first NOR circuit is configured to receive two outputs of the logic circuit.

9. The driving circuit of claim 8, wherein at least one of the outputs of the logic circuit is fixed in the partial-screen display mode.

10. The driving circuit of claim 8, wherein the logic circuit includes a second NOR circuit, the second NOR circuit is configured to receive the partial-display mode signal and an inversion signal of the received signal, and the delay section is configured to delay and invert an output signal of the second NOR circuit.

11. The driving circuit of claim 10, wherein the output signal of the delay section is a fixed signal in the partial-screen display mode.

12. The driving circuit of claim 1, wherein each stage of the shift register includes a set-reset flip-flop.

13. The driving circuit of claim 1, wherein the shift register is enabled to shift in two directions.

14. The driving circuit of claim 1, wherein the received signal is a signal of a double pulse.

15. The driving circuit of claim 1, wherein the shift register starts shifting from an in-between stage in the partial-screen display mode.

16. A display device, comprising a driving circuit defined in claim 1.

17. A method of driving a display device by a driving circuit, the driving circuit including a shift register and a signal processing circuit connected to a stage of the shift register, the method comprising:

processing, by the signal processing circuit, a signal pulse received from the stage of the shift register;

delaying, by the signal processing circuit, the signal pulse if the display device is in wide-screen mode, wherein the delaying step delays the signal pulse by inverting the signal pulse; and interrupting, by the signal processing circuit, the signal pulse if the display device is in partial-screen display mode.

18. The method of claim 17, wherein the interrupting step interrupts the signal pulse or the delaying step delays the signal pulse based on a state of a partial-display mode signal.

19. The method of claim 18, wherein the interrupting step delays the signal pulse if the partial-display mode signal is in an off state.

20. The method of claim 19, wherein the signal pulse is interrupted by a NOR operation involving the signal pulse and the partial-display mode signal.

21. A driving circuit of a display device, by which circuit a non-display area is created on a display section of the display device so that a partial-screen display becomes available, the driving circuit comprising:

a shift register; and a signal processing circuit connected to a stage of the shift register, the signal processing circuit configured to process a signal received from the stage of the shift register, the signal processing circuit including an interrupting circuit, the interrupting circuit configured to delay the received signal if the display device is in wide-screen mode, the interrupting circuit configured to interrupt the received signal if the display device is in partial-screen display mode, wherein the interrupting circuit is configured to interrupt the received signal based on a state of a partial-display mode signal, wherein the interrupting circuit includes a first NOR circuit and a logic circuit that includes a delay section, and the logic circuit is configured to receive the partial-display mode signal and the received signal, and the first NOR circuit is configured to receive two outputs of the logic circuit.

* * * * *